US011694606B2

(12) United States Patent
Kuo et al.

(10) Patent No.: US 11,694,606 B2
(45) Date of Patent: Jul. 4, 2023

(54) DISPLAY DEVICE WITH SENSING ELEMENT

(71) Applicant: INDUSTRIAL TECHNOLOGY RESEARCH INSTITUTE, Hsinchu (TW)

(72) Inventors: Wen-Yu Kuo, Hsinchu County (TW); Wei-Chung Chen, Kaohsiung (TW); Yi-Hsiang Huang, Changhua (TW); Yu-Hsiang Liu, Chiayi (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 0 days.

(21) Appl. No.: 17/530,007

(22) Filed: Nov. 18, 2021

(65) Prior Publication Data

US 2022/0262301 A1 Aug. 18, 2022

Related U.S. Application Data

(60) Provisional application No. 63/116,931, filed on Nov. 23, 2020.

(30) Foreign Application Priority Data

Nov. 12, 2021 (TW) ..... 110142157

(51) Int. Cl.
*G09G 3/32* (2016.01)

(52) U.S. Cl.
CPC ..... *G09G 3/32* (2013.01); *G09G 2320/0626* (2013.01); *G09G 2360/144* (2013.01)

(58) Field of Classification Search
CPC ..... G09G 2320/0626; G09G 2360/144; G09G 2300/0426; G09G 3/32; G09G 2300/0819;

(Continued)

(56) References Cited

U.S. PATENT DOCUMENTS 8,575,530 B2 11/2013 Chan
11,404,002 B2 * 8/2022 Song ..... H01L 27/3227

(Continued)

FOREIGN PATENT DOCUMENTS

CN 101527118 B 9/2009
CN 102725784 A 10/2012

(Continued)

OTHER PUBLICATIONS

Taiwan Office Action dated Oct. 31, 2022 as received in application No. 110142157.

(Continued)

*Primary Examiner* — Muhammad N Edun
(74) *Attorney, Agent, or Firm* — Maschoff Brennan

(57) ABSTRACT

A display device with sensing element includes a substrate having a disposing surface, a plurality of display elements, at least one sensing element, and at least one lighting adjustment element. The display elements are disposed above the disposing surface to present an image. The at least one sensing element disposed above the disposing surface to sense a light brightness projected toward either side of the substrate. The at least one light adjustment element is in signal transmittable connection with the display elements and the at least one sensing element. The at least one light adjustment element adjusts a plurality of control signals inputted into the display elements to determine a contrast of the image.

17 Claims, 18 Drawing Sheets

(58) Field of Classification Search
CPC ... G09G 2300/0842; G09G 2320/0295; G09G 3/3233; G09G 2310/0251
See application file for complete search history.

(56) References Cited

U.S. PATENT DOCUMENTS

| | | | | |
|---|---|---|---|---|
| 2005/0285822 | A1* | 12/2005 | Reddy | H01L 27/1446 345/76 |
| 2019/0266955 | A1 | 8/2019 | Kurokawa | |
| 2019/0363792 | A1 | 11/2019 | Tsonev | |
| 2021/0335251 | A1* | 10/2021 | Liu | H01L 27/3218 |
| 2022/0067340 | A1* | 3/2022 | Han | H01L 51/5284 |

FOREIGN PATENT DOCUMENTS

| | | | |
|---|---|---|---|
| CN | 110070814 | A | 7/2019 |
| TW | 201211974 | A | 3/2012 |
| TW | 201430810 | A | 8/2014 |
| TW | 202014771 | A | 4/2020 |

OTHER PUBLICATIONS

TW Office Action dated Feb. 22, 2023 as received in Application No. 110142157.

* cited by examiner

DISPLAY DEVICE WITH SENSING ELEMENT

TECHNICAL FIELD

This disclosure relates to a display device with sensing element.

BACKGROUND

With the development of technology, display device has evolved from an opaque form to a transparent form in order to expand the application range of the display device. For example, the vehicle-mounted display device has gradually developed from installed at a console of a vehicle to a head-up display (HUD) installed at a window or windshield. The head-up display is usually used to display information such as vehicle speed, navigation path, etc., so that the driver may see the conditions on the road ahead and the information displayed on the display device at the same time without losing sight.

However, transparent display device is easily affected by ambient light, which lowers the image contrast viewed by the viewer. Specifically, when the display device is irradiated by sunlight, the visibility of the image displayed on the display device is reduced due to the sunlight. For example, the nonhomogeneous brightness of the displayed image causes the contrast of parts of the image to decrease. Therefore, when the viewer is view the image, the viewer may experience discomfort or may be unable to correctly read the message displayed on the display device. Further, if the transparent display device is implemented as a head-up display, the driver is more likely to be unable to read the information displayed on the display in real time and clearly, thereby reducing driving safety or increasing the difficulty of driving.

SUMMARY

According to an embodiment of the present disclosure, a display device with sensing element includes: a substrate having a disposing surface; a plurality of display elements, disposed above the disposing surface to present an image; at least one sensing element disposed above the disposing surface to sense light brightness of light projected toward either side of the substrate; and at least one light adjustment element in signal-transmittable connection with the display elements and the at least one sensing element, with the at least one light adjustment element adjusting a plurality of control signals inputted into the display elements to determine a contrast of the image.

The display device with sensing element according to one or more embodiments of the present application may collect the sensing signal of a partial area to adjust the contrast of the area, thereby improving the visibility of the display device. Accordingly, driving safety may also be improved as well as avoid the viewer from feeling discomfort in the eyes. In addition, in the display device with sensing element according to one or more embodiments of the present application, by integrating the light adjustment element into the display panel, the display device may have light adjustment function and may maintain the lightness and thinness of the display device. Further, according to one or more embodiments of the present application, the element inside the display device may adjust the image contrast without the need for additional adjustment through external system side.

The above description of the summary of this invention and the description of the following embodiments are provided to illustrate and explain the spirit and principles of this invention, and to provide further explanation of the scope of this invention.

DETAILED DESCRIPTION

The detailed features and advantages of this invention will be described in detail in the following description, which is intended to enable any person having ordinary skill in the art to understand the technical aspects of this invention and to practice it. In accordance with the teachings, claims and the drawings of this invention, any person having ordinary skill in the art is able to readily understand the objectives and advantages of this invention. The following embodiments illustrate this invention in further detail, but the scope of this invention is not limited by any point of view.

The display device with sensing element of an embodiment of the present disclosure is, for example, a transparent display device, and may be a head-up display (HUD) installed at a window or windshield of a vehicle. With the display device with sensing element of one or more embodiments of the present disclosure, impacts of ambient light on the image displayed by the display device may be reduced.

Figure 1A:
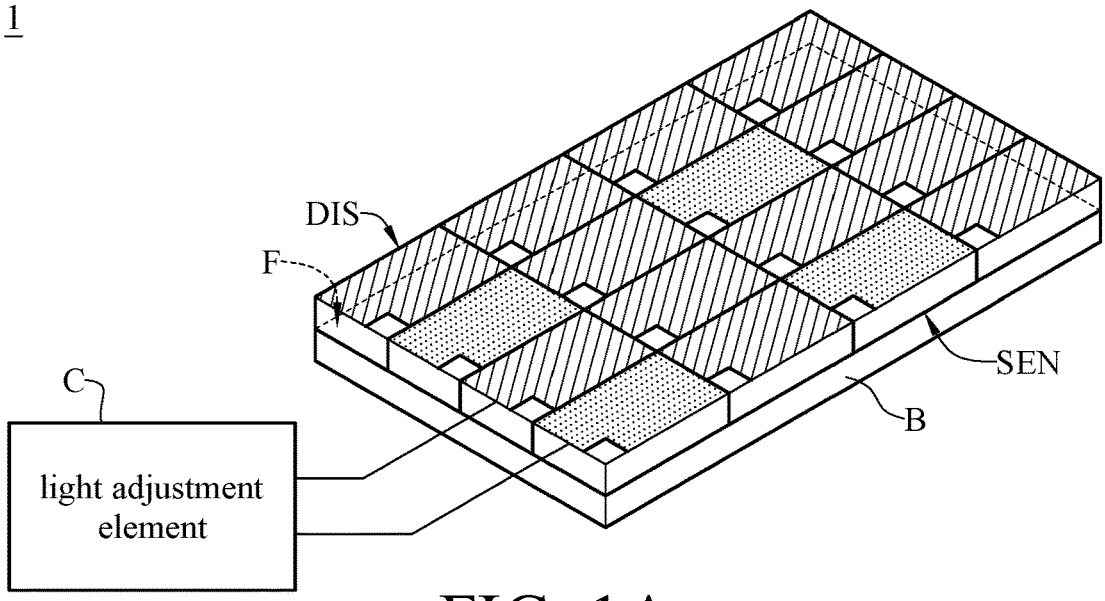
FIGS. 1A and 1B are schematic diagrams illustrating a display device with sensing element according to a first embodiment of the present disclosure.
Figure 1B:
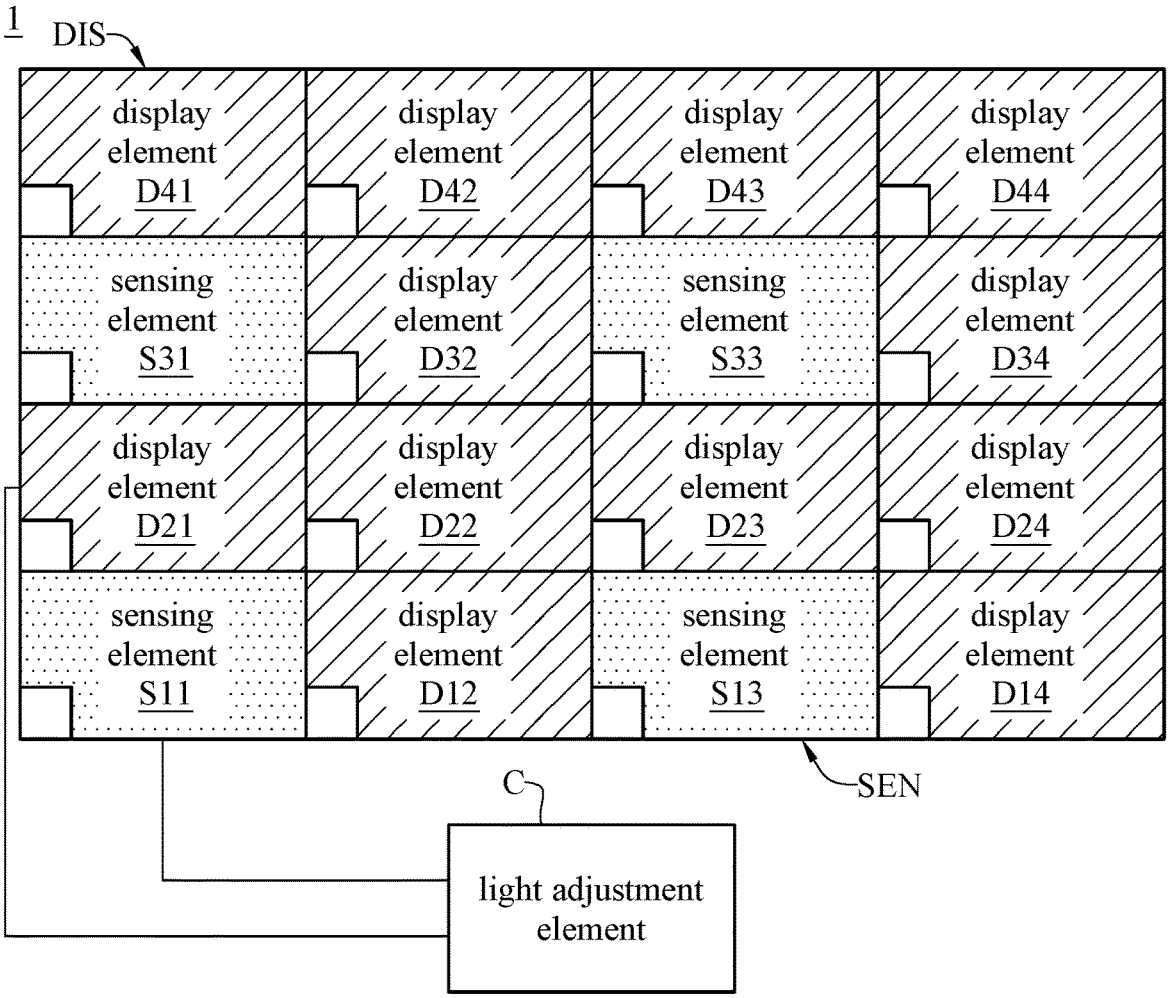

Please refer to FIGS. 1A and 1B. FIGS. 1A and 1B are schematic diagrams illustrating a display device with sensing element according to a first embodiment of the present disclosure. The display device 1 includes a substrate B, a display element group DIS, a sensing element group SEN and at least one light adjustment element C (i.e. one or more light adjustment element C). The display element group DIS includes a plurality of display elements, and the sensing element group SEN includes a plurality of sensing element.

The substrate B has a disposing surface F. The substrate B is preferably a transparent substrate. The display element group DIS may be disposed above the disposing surface F, and the display element group DIS is configured to display an image. The sensing element group SEN may be disposed above the disposing surface F or any other side of the substrate B to sense the brightness of the light (referred to as "light brightness" herein) projected to any side of the substrate B.

Specifically, take FIG. 1B as an example, the display element group DIS may include the display elements D12, D14, D21 to D24, D32, D34, and D41 to D44; the sensing element group SEN may include the sensing elements S11, S13, S31, S33. The display element group DIS and the sensing element group SEN may be arranged as an array, and one sensing element may be adjacent to a plurality of display elements or surrounded by a plurality of display elements. In other words, a display panel of the display device 1 of the first embodiment may have a plurality of subareas, with each subarea including at least one display element and at least one sensing element. For example, the display elements D41, D42, D32 and the sensing element S31 may form a subarea, the display elements D43, D44, D34 and the sensing element S33 may form another subarea, and so on.

The light adjustment element C may be a computing element with computing functions, for example, an integrated circuit chip, the present disclosure does not limit the type of the light adjustment element C (computing element). It should be noted that, when the light adjustment element C is implemented as an integrated circuit chip, the light adjustment element C is disposed outside of the array arranged with the display element group DIS and the sensing element group SEN as shown by FIGS. 1A and 1B, but the light adjustment element C may also be integrated into the array arranged with the display element group DIS and the sensing element group SEN in other embodiments of the present disclosure.

The light adjustment element C is connected to (electrically connected to or in communication connection with) the display element group DIS and the sensing element group SEN, and adjust a plurality of control signals inputted into the display element group DIS according to the light brightness to determine a contrast of the image displayed by the display element group DIS. Specifically, the display element group DIS may include at least one of a plurality of light-emitting elements and a of a plurality of dimming elements, and the light adjustment element C may adjust the control signals respectively inputted into the light-emitting elements and/or the dimming elements. In detail, when the display element group DIS is the light-emitting elements, the control signals outputted by the light adjustment element C may be used to adjust the image brightness presented by the light-emitting elements; when the display element group DIS is the dimming elements, the control signals outputted by the light adjustment element C may be used to adjust a light-shielding degree of the dimming elements; and when the display element group DIS includes both the light-emitting elements and the dimming elements, the control signals outputted by the light adjustment element C may be used to simultaneously adjust the image brightness of the light-emitting elements and the light-shielding degree of the dimming elements. Each of the light-emitting elements described above (such as the light-emitting element LI shown in FIG. 3) may be a light-emitting diode (LED), an organic light-emitting diode (OLED) or a micro light-emitting diode (micro-LED) etc. Each of the dimming elements described above (such as the dimming element M shown in FIG. 4) may be a polymer dispersed liquid crystal (PDLC) light-shielding element or an electrochromic (EC) light-shielding element, or may be a microelectromechanical system (MEMS) structure with light-shielding function.

The sensing element group SEN of the display device 1 senses the light brightness, and may selectively output a corresponding brightness signal (for example, corresponding to a current of the light brightness) to the light adjustment element C. When the light adjustment element C determines the brightness signal or a value of the brightness signal is higher than an upper limit, it means the ambient light around the display device 1 may be too bright and may cause a decrease in contrast of the image viewed by the viewer. Accordingly, the light adjustment element C may adjust the control signals inputted into the light-emitting elements according to a compensation value, and/or adjust the control signals inputted into the dimming elements, thereby compensating for the impact of ambient light by increasing the contrast of the image. In the first embodiment, the light adjustment element C may convert the analog brightness signal into a digital brightness signal, and the light adjustment element C may perform an algorithm according to the digital brightness signal to calculate a compensation value. In addition, the light adjustment element C may also obtain the compensation value by a look-up table (LUT), and adjust the control signals inputted into the light-emitting elements and/or the dimming elements according to the compensation value. The compensation value may be a compensation value used to compensate for the brightness of the light-emitting element, a compensation value used to compensate for RGB color balance, or a compensation value used to compensate for the light-shielding degree of the dimming element.

Figure 2:
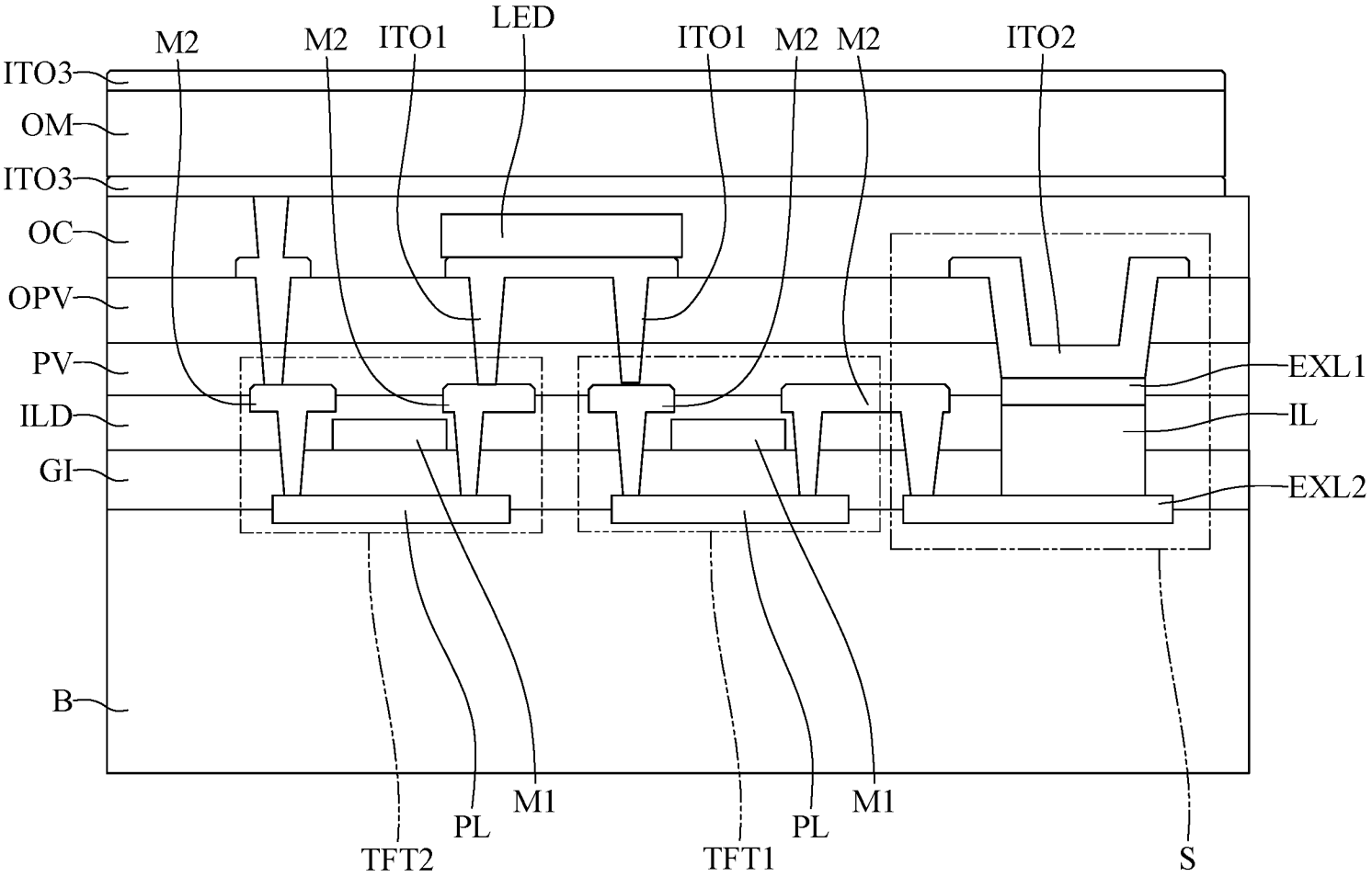
FIG. 2 is a structural diagram illustrating the display device with sensing element according to the first embodiment of the present disclosure.

FIG. 2 is a structural diagram illustrating the display device with sensing element according to the first embodiment of the present disclosure, wherein the display element group DIS includes the above-mentioned light-emitting element and the dimming element. In the following description, the light-emitting element is represented by the light-emitting diode LED, and the dimming element is represented by a light-shielding element OM.

In FIG. 2, the structure of the display device 1 may be a single-layer or multi-layer structure including, for example, the substrate B, a first insulating layer GI, a second insulating layer ILD, a third insulating layer PV, a first planarization insulating layer OPV and a second planarization insulating layer OC. The first insulating layer GI, the second insulating layer ILD and the third insulating layer PV may be single-layer or multi-layer structure formed by silicon oxide (SiOx) and silicon nitride (SiNx), the present disclosure does not limit the materials of the first insulating layer GI, the second insulating layer ILD and the third insulating layer PV. The first planarization insulating layer OPV and the second planarization insulating layer OC may be made of materials such as acryl resin, epoxy resin etc., the present disclosure does not limit the materials of the first planarization insulating layer OPV and the second planarization insulating layer OC.

For example, a first transistor TFT1 may penetrate from the third insulating layer PV to the first insulating layer GI. The first transistor TFT1 includes, for example, a polysilicon layer PL, a first metal electrode M1 and two second metal electrodes M2, wherein the first metal electrode M1 may be a gate electrode, and the two second metal electrodes M2 may be a source electrode and a drain electrode. The first transistor TFT1 in FIG. 2 may be a driving transistor for controlling the sensing element S and the light-emitting diode LED.

The light-emitting diode LED may be mounted onto the first planarization insulating layer OPV above the substrate B through evaporation process or transferring process, with the light-emitting diode LED covered by the second planarization insulating layer OC. The light-emitting diode LED includes two first transparent electrodes ITO1, which may penetrate to the third insulating layer PV from the second planarization insulating layer OC. The first transparent electrode ITO1 may be made of indium tin oxide or other suitable materials. The two first transparent electrodes ITO1 of the light-emitting diode LED are electrically connected to the second metal electrode of the first transistor TFT1 and the second metal electrode of the second transistor TFT2, respectively. The structure of the second transistor TFT2 may be the same as that of the first transistor TFT1.

The sensing element S of the sensing element group SEN may include a second transparent electrode ITO2, a first extrinsic semiconductor layer EXL1, a second extrinsic semiconductor layer EXL2 and an intrinsic semiconductor layer IL located between the first extrinsic semiconductor layer EXL1 and the second extrinsic semiconductor layer EXL2. The second transparent electrode ITO2 may be made of indium tin oxide or other suitable materials. the first extrinsic semiconductor layer EXL1 may be a n-type semiconductor, the second extrinsic semiconductor layer EXL2 may be a p-type semiconductor (for example, highly doped polysilicon (P+)), and the intrinsic semiconductor layer IL may be an amorphous silicon (a-Si) layer. In other words, the sensing element S may be implemented by PIN-type photodiode. In addition, the light-emitting diode disposed by evaporation process or the micro light-emitting diode disposed by transferring process may also be used as the sensing element S, the present disclosure does not limit the implementation of the sensing element S.

In this embodiment, the light-shielding element OM may be disposed on, for example, the second planarization insulating layer OC. The light-shielding element OM may be wrapped by a third transparent electrode ITO3, and the third transparent electrode ITO3 may extend from the second planarization insulating layer OC to the third insulating layer PV to be electrically connected to the second transistor TFT2. The third transparent electrode ITO3 may be made of indium tin oxide or other suitable materials. The second transistor TFT2 shown in FIG. 2 may be used as the driving transistor for controlling the light-emitting diode LED and the light-shielding element OM. In addition, a projection of the light-shielding element OM on the substrate B contains a projection of the light-emitting diode LED on the substrate B.

It should be noted that, the structures and bonding locations of the light-emitting diode LED, the light-shielding element OM and the sensing element S shown in FIG. 2 are merely examples. The structures and bonding locations of the light-emitting diode LED, the light-shielding element OM and the sensing element S may be modified based on requirements.

Figure 3:
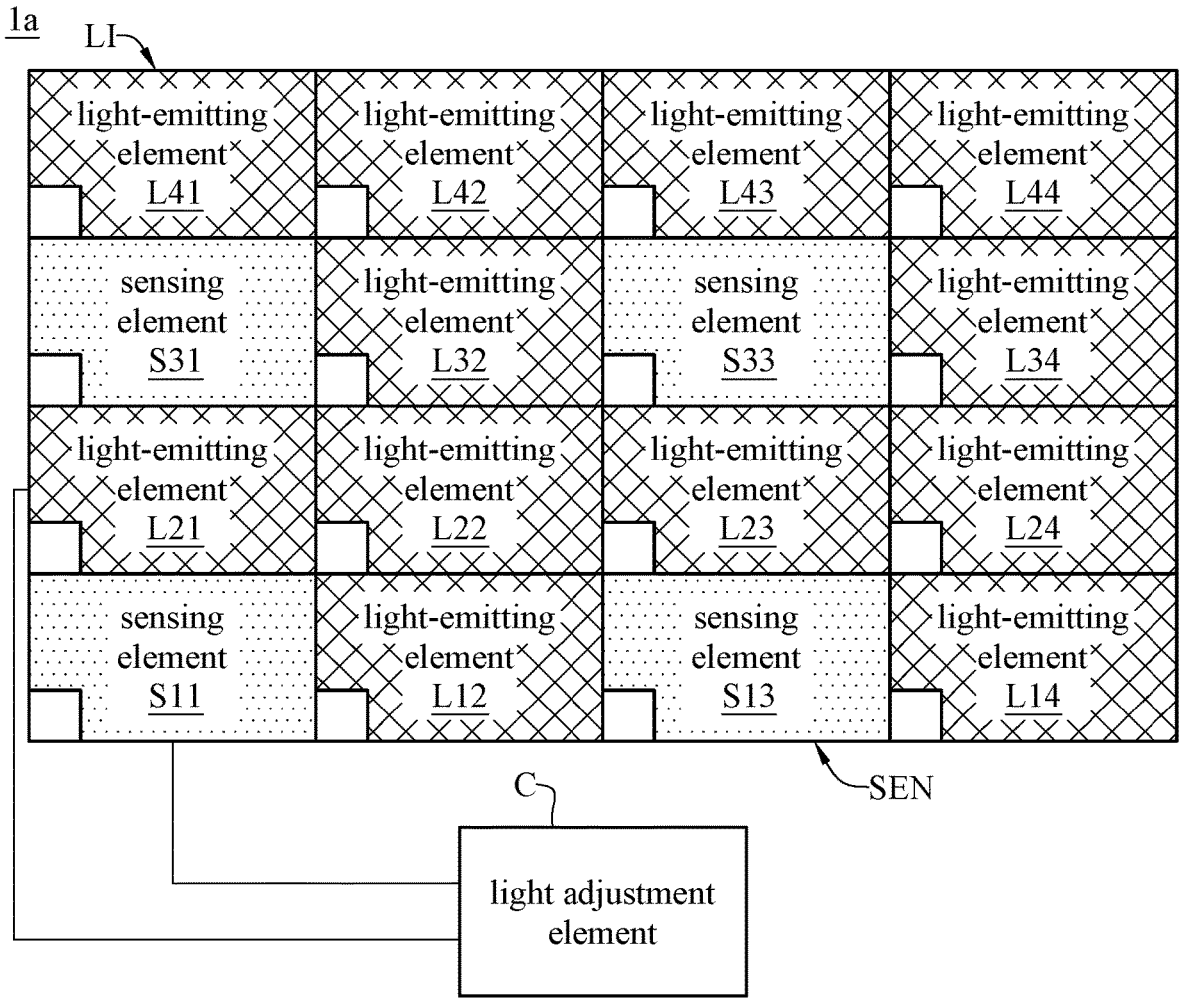
FIG. 3 is an implementation of the display device with sensing element according to the first embodiment of the present disclosure.

Please refer to FIG. 3. FIG. 3 is an implementation of the display device with sensing element according to the first embodiment of the present disclosure. In this embodiment, the display element group DIS of the display device 1*a* may be the light-emitting element group LI. That is, the light-emitting element group LI of the display device 1*a* may include a plurality of light-emitting elements L12, L14, L21 to L24, L32, L34 and L41 to L44, and each of the light-emitting elements may have a light-emitting diode and/or an organic light-emitting diode etc. The light-emitting element group LI and the sensing element group SEN of the display device 1*a* are disposed on the same substrate, and the location between the light-emitting element group LI and the sensing element group SEN and the substrate may be the same as FIG. 1A.

Further, as shown by FIG. 3, the display device 1*a* has a plurality of light-emitting elements and a plurality of sensing elements, wherein one sensing element may be adjacent to a plurality of light-emitting elements or surrounded by a plurality of light-emitting elements. Therefore, assuming only the brightness signal of the sensing element S33 among the sensing element group SEN is higher than the upper limit, the light adjustment element C may adjust the control signal inputted into, for example, at least one of the light-emitting elements L22 to L24, L32, L34, L42, L43 and L44 based on the algorithm, and not adjust the control signals inputted into the remaining light-emitting elements L12, L14, L21 and L41. Therefore, only the image contrast around the sensing element S33 is adjusted without misadjusting the contrast of other areas.

The algorithm may be performed according to the following equation (1). The light adjustment element C adjusts the control signals inputted into the light-emitting elements for matching the value calculated from equation (1) to a default ratio, so that the value calculated from equation (1) is equal to or larger than a default ratio.

$$\frac{L_{ENV} + L_{DIS1} + L_{DISR}}{L_{ENV} + L_{DIS2} + L_{DISR}} \quad \text{equation (1)}$$

$L_{ENV}$ is the light brightness sensed by at least one sensing element among the sensing element group SEN; $L_{DIS1}$ is a first brightness corresponding to the control signals, that is, the first brightness is the brightness of the display element group DIS displaying an image; $L_{DIS2}$ is a second brightness corresponding to the control signals, that is, the second brightness is the brightness of the display element group DIS displaying an image; $L_{DISR}$ is a brightness corresponding to a light of the light brightness reflected from the display device 1. In other words, $L_{ENV}$ is an ambient light penetration brilliance; $L_{DIS1}$ is the brilliance of a bright area of the image presented by the display device 1; $L_{DIS2}$ is the brilliance of a dark area of the image presented by the display device 1; $L_{DISR}$ is the reflected light brilliance of the display device 1 reflecting ambient light projected to the display device 1. $L_{ENV}$ may be obtained by the sensing element group SEN sensing the ambient light; $L_{DIS1}$ and $L_{DIS2}$ may be obtained according to the brightness of the image signal inputted into the light-emitting element LI; and $L_{DISR}$ is obtained through the sensing element group SEN.

When the calculated value is not larger than the default ratio, for example, the default ratio is 1.5, the light adjustment element C calculates the image compensation value for compensating at least one light-emitting element among the light-emitting element group LI. In addition, if the sensing element group SEN and the light adjustment element C are electrically connected to or in communication connection with an external system, the image compensation value may also be calculated by the external system, and the external system outputs the calculated image compensation value to the light adjustment element C.

The light adjustment element C stores a plurality of brightness values and a plurality of compensation values respectively corresponding to the brightness values. The light adjustment element C determines the light brightness sensed by the sensing element group SEN falls in an interval defined by two of the brightness values, and uses one of the compensation values corresponding to the interval as the image compensation value. Specifically, according to the definition of equation (1), when the sensed light brightness $L_{ENV}$ representing the sensed ambient light (the background light of the display device) changes, the bright area brilliance $L_{DIS1}$ of the display device may be adjusted for the value calculated from equation (1) to be maintained at a value larger than the default ratio (1.5). That is, the bright area brilliance $L_{DIS1}$ of the display device may be adjusted for the brightness of at least one light-emitting element of the light-emitting element group LI to become brighter. In addition, when the light adjustment element C is in communication connection with another computing device (for example, a server at the display device vendor end), the image compensation value may also be calculated by said another computing device.

The range of the brightness values stored by the light adjustment element C is, for example, from 0 to 100000 lux. The range is divided into 4096 intervals respectively represented by X1, X2, . . . , X4096, and the corresponding compensation values (compensation voltage or compensation current) may be represented by Y1, Y2, . . . , Y4096. The brightness value of 0 may represent the light brightness at night, and the brightness value of 100000 may represent the light brightness at noon. Assuming the ambient light penetration brilliance $L_{ENV}$ read from the sensing element is X, the light adjustment element C may further determine the interval (Xn>X>Xn+1) the brilliance X falls into. Then, the light adjustment element C determines the relationship between X and (Xn+Xn+1)/2. For example, when the light adjustment element C determines X is larger than (Xn+Xn+1)/2, the light adjustment element C may output the compensation voltage or compensation current of Yn+1; when the light adjustment element C determines X is smaller than (Xn+Xn+1)/2, the light adjustment element C may output the compensation voltage or compensation current of Yn.

Similarly, when the light adjustment element C determines the brightness signal representing the light brightness is lower than a lower limit, it means the surrounding of the display device 1*a* may be too dark, thereby causing the contrast of the image displayed by the display device 1*a* to be too sharp or the display device 1*a* to be too bright which may further lead to discomfort for the viewer's eyes. Therefore, the light adjustment element C may determine whether to adjust the control signal according to equation (1), further determine the image compensation value according to the light brightness when the control signal is determined to require adjustment, and adjust the control signal inputted into at least one light-emitting element among the light-emitting element group LI according to the image compensation value. Accordingly, the contrast of the image and/or the brightness of the image may be reduced. Also, as described above, when not all brightness signals (light brightness) for all subareas of the display device are the same, the light adjustment element C may only adjust the control signals inputted into part of the light-emitting element group LI.

In addition, the image compensation value may also be used to compensate for the color balance of the image. Specifically, the image compensation value for color balance may be obtained by: with an expected brightness of the display device calculated from CIE 1931 color space coordinates according to equation (1) (or according to color matching function of the human eye for different ambient lights), using the brightness of each of the three primary colors of RGB calculated from the target white balance color coordinates as the image compensation value. Then, the compensation voltage or compensation current may be outputted to the light-emitting element group LI.

Figure 4:
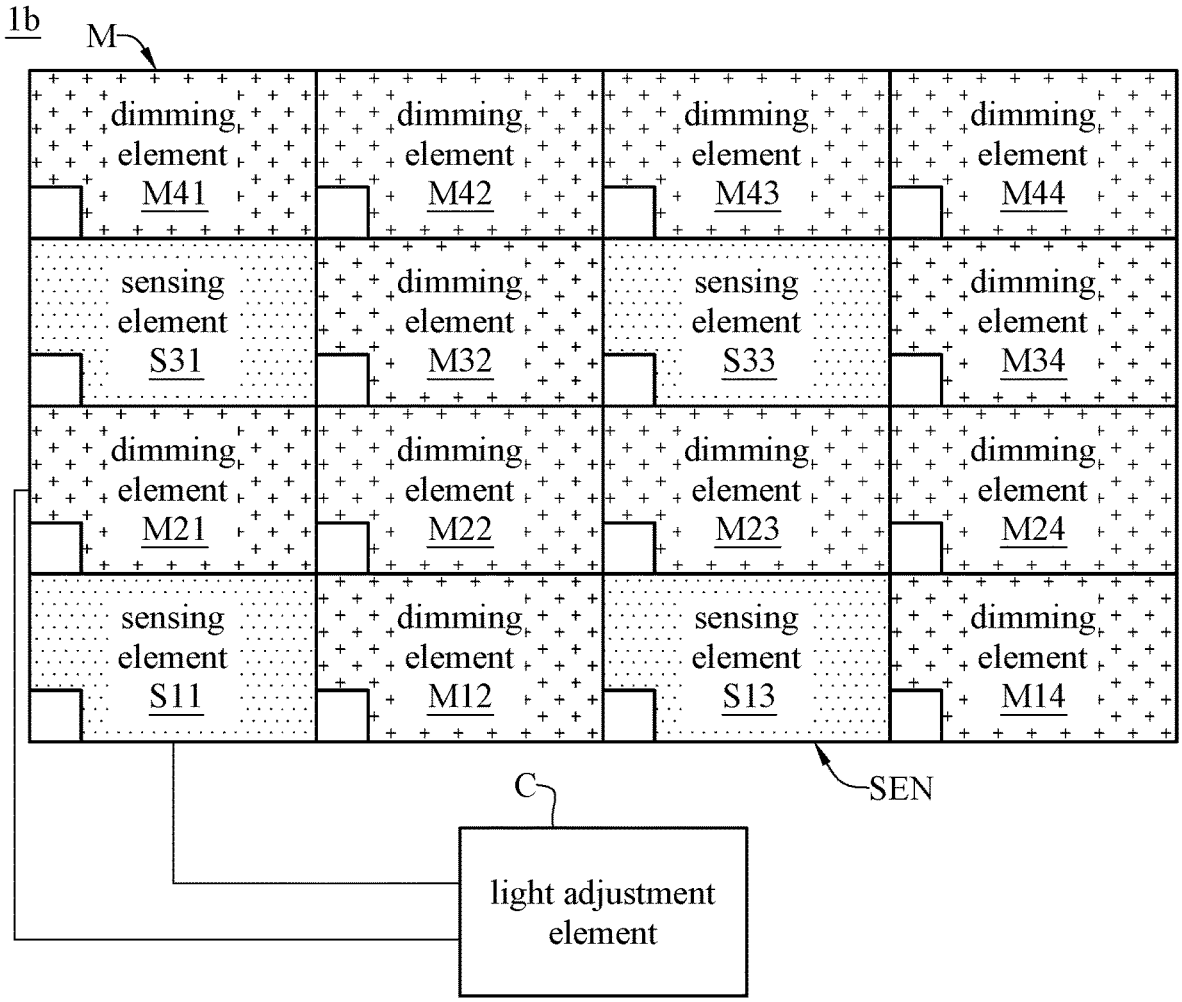
FIG. 4 is an implementation of the display device with sensing element according to the first embodiment of the present disclosure.

Please refer to FIG. 4. FIG. 4 is an implementation of the display device with sensing element according to the first embodiment of the present disclosure. In this embodiment, the light-emitting element is disposed on another substrate. That is, the dimming element group M and the sensing element group SEN of the display device 1*b* shown in FIG. 4 are disposed on the same substrate, and the relative location between the dimming element group M and the sensing element group SEN and the substrate may be the same as FIG. 1A shown.

In this embodiment, the display element group DIS of the display device 1*b* may be a dimming element group M.

That is, the dimming element group M of the display device 1*b* may include the dimming element M12, M14, M21 to M24, M32, M34, M41 to M44. The light-emitting element of the display device 1*b* may be disposed on another substrate, and the dimming element group M may be used to shield light for the light-emitting element on said another substrate.

After the sensing element group SEN sensing the light brightness, the sensing element group SEN outputs a corresponding brightness signal (for example, a current corresponding to the light brightness) to the light adjustment element C. When the light adjustment element C determines the brightness signal or a value of the brightness signal is higher than an upper limit, it means the ambient light around the display device 1*b* may be too dark, which causes the decrease in contrast of the image displayed by the display device 1*b*. Therefore, based on the algorithm, the light adjustment element C may calculate the light-shielding compensation value according to the brightness signal, wherein the light-shielding compensation value is for compensating at least one light adjustment element of the dimming element group M. Then, the light adjustment element C may adjust the control signal inputted into at least one light adjustment element of the dimming element group M according to the light-shielding compensation value to enhance image contrast. The light-shielding compensation value may be used to compensate for the light-shielding degree (or other parameters that might impact image brightness or image contrast) of the dimming element group M.

Further, as shown by FIG. 4, the numbers of the dimming elements and the sensing elements may be more than 1, and one sensing element may be adjacent to a plurality of dimming elements or surrounded by a plurality of dimming elements. Therefore, assuming only the brightness signal of the sensing element S33 among the sensing element group SEN is higher than the upper limit, the light adjustment element C may adjust the control signal inputted into, for example, at least one of the dimming element M34, M43 and M44 according to the algorithm, and not adjust the control signals inputted into the remaining M12, M14, M21 to M24, M32, M41 and M42. Therefore, only the image contrast around the sensing element S33 is enhanced without misadjusting the contrast of other areas.

It should be noted that, the light-shielding compensation value may be calculated in the same way as the image compensation value. For example, the range of a plurality of brightness values stored in the light adjustment element C is divided into X1, X2, . . . , X4096, the corresponding compensation value (light-shielding compensation voltage or compensation current) may be Z1, Z2, . . . , Z4096. Assuming the ambient light penetration brilliance $L_{ENV}$ read from the sensing element is X, the light adjustment element C may further determine the interval (Xn>X>Xn+1) the brilliance X falls into. Then, the light adjustment element C determines the relationship between X and (Xn+Xn+1)/2. For example, when the light adjustment element C determines X is larger than (Xn+Xn+1)/2, the light adjustment element C may output the compensation voltage or compensation current of Zn+1 to the dimming element; when the light adjustment element C determines X is smaller than (Xn+Xn+1)/2, the light adjustment element C may output the compensation voltage or compensation current of Zn to the dimming element.

Similarly, when the light adjustment element C determines the brightness signal representing the light brightness is lower than a lower limit, it means the surrounding of the display device 1*b* may be too dark, thereby causing contrast of the image displayed by the display device 1*b* to be too sharp or the display device 1*b* is too bright which may further lead to discomfort for the viewer's eyes. Therefore, the light adjustment element C may determine whether to adjust the control signals according to equation (1), further determine the light-shielding compensation value according to the brightness signal when the control signals are determined to require adjustment, and adjust the control signals inputted into the dimming elements M according to the light-shielding compensation value. Accordingly, the contrast of the image may be reduced by reducing the light-shielding degree of the display device 1*b* (i.e. increasing the transmittance of the display device 1*b*). Further, as described above, when the brightness signals (light brightness) of the entire display device are not all the same, the light adjustment element C may only adjust the control signals inputted into part of the dimming element group M.

In addition, when the image compensation value is used to compensate for the color balance of the image, the brightness of each of the three primary colors of RGB calculated from the target white balance color coordinates may be used as the image compensation value. Then, the compensation voltage or compensation current may be outputted to the dimming element group M.

Figure 5A:
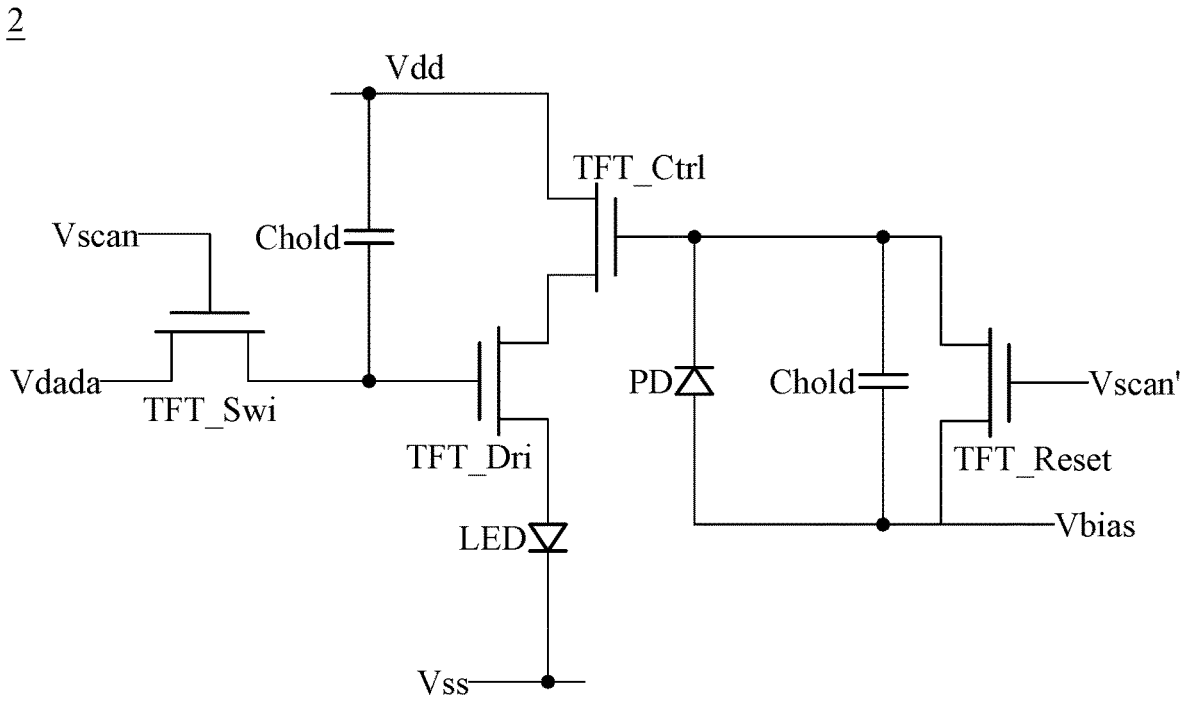
FIG. 5A illustrates circuit diagram of a sensing element/light adjustment element and a light-emitting element of a second embodiment of the present disclosure.

In other embodiments, the light adjustment element and the sensing element may be implemented by photo element and passive element in the array to shorten the duration of signal transmission between the sensing element/the light adjustment element and the display elements as well as lower the cost of the display device. Please refer to FIG. 5A. FIG. 5A illustrates circuit diagram of a sensing element/light adjustment element and a light-emitting element of a second embodiment of the present disclosure. In this embodiment, the display elements may be the light-emitting diode LED or other suitable element, and the sensing element/the light adjustment element may be implemented by photo element (such as photodiode or other suitable element).

The sensing element and the light-emitting element of the display device 2 may be arranged as an array and disposed on a substrate. The circuit structure of the display device 2 is described as follow. A control end of a switching transistor TFT_Swi receives a scan voltage Vscan, a first end of the switching transistor TFT_Swi receives a data voltage Vdata, a second end of the switching transistor TFT_Swi is connected to a control end of a driving transistor TFT_Dri. The scan voltage Vscan may be used to charge the pixels in the display device 2. For example, the scan voltage Vscan may be used to charge the display elements and the sensing element/the light adjustment element of the display device 2, or may be used to scan the transistors to determine whether the transistors are turned on or off. The control end of the driving transistor TFT_Dri may be further connected to a capacitor Chold. The first end of the driving transistor TFT_Dri is connected to an anode of the light-emitting diode LED, the second end of the first driving transistor TFT_Dri1 is connected to a second end of the control transistor TFT_Ctrl. The cathode of the light-emitting diode LED is configured to receive a low-level voltage Vss.

The first end of the control transistor TFT_Ctrl receives a high-level voltage Vdd, the control end of the control transistor TFT_Ctrl is connected to the photo diode PD. The photo diode PD may be connected in parallel with another capacitor Chold. One end of the another capacitor Chold is connected to the control end of the control transistor TFT_Ctrl and a first end of a reset transistor TFT_Reset, another end of the another capacitor Chold is connected to a second end of the reset transistor TFT_Reset and is configured to receive a bias voltage Vbias. A control end of the reset transistor TFT_Reset is configured to receive a scan voltage Vscan' of a previous stage. The scan voltage Vscan may be used to scan the transistors to determine whether the transistors are turned on or off. Assuming the display device 2 has N rows of pixels, the scan voltage Vscan may scan from the first row to the Nth row in a column direction in a stage-by-stage manner, wherein N is a positive integer. The scan voltage Vscan' of the previous stage may be used to preprocess the pixel that is about to be scanned by the scan voltage Vscan of the current stage, wherein said "preprocess" indicates initializing the pixel or turn off the display elements in advance to prepare for data writing. In this embodiment, the photo diode PD may be used as the light adjustment element for adjusting the control signal inputted into the light-emitting diode LED.

Figure 5B:
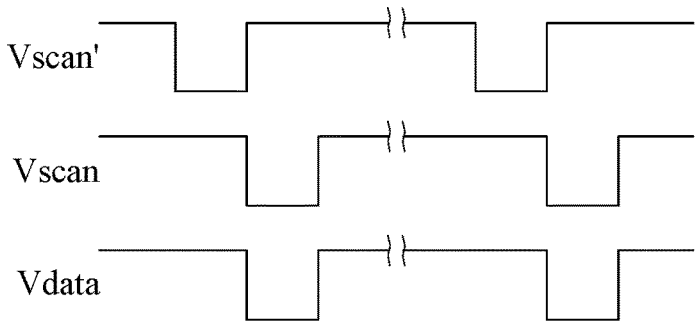
FIG. 5B illustrates waveforms of the voltages in FIG. 5A.

Please refer to FIGS. 5A and 5B together, wherein FIG. 5B illustrates waveforms of the voltages in FIG. 5A. An upper limit of the operating voltage range of the light-emitting diode LED is the high-level voltage Vdd, the lower limit is the low-level voltage Vss, with the bias voltage Vbias being between the high-level voltage Vdd and the low-level voltage Vss for the control transistor TFT_Ctrl to constantly maintain in an opening state. When the scan voltage Vscan is inputted into the switching transistor TFT_Swi, the data voltage Vdata drives the driving transistor TFT_Dri for the light-emitting diode LED to emit light. The photo diode PD senses the ambient light to generate photovoltaic for the current flowing through the control transistor TFT_Ctrl to increase. Lastly, the reset transistor TFT_Reset performs reset process before writing according to the scan voltage Vscan' of the previous stage to initialize the photo diode PD. Accordingly, the sensing element (the photo diode (PD)) may be directly controlled by the light-emitting element.

In this embodiment, the photo voltage after the sensing element SEN sensing the light controls the switch on the driving loop of the light-emitting element LI to further control the operation of the light-emitting element LI. The sensing element SEN may perform initialization before data writing. Any circuit that conforms to this concept should be considered within the scope of the present invention.

Figure 6A:
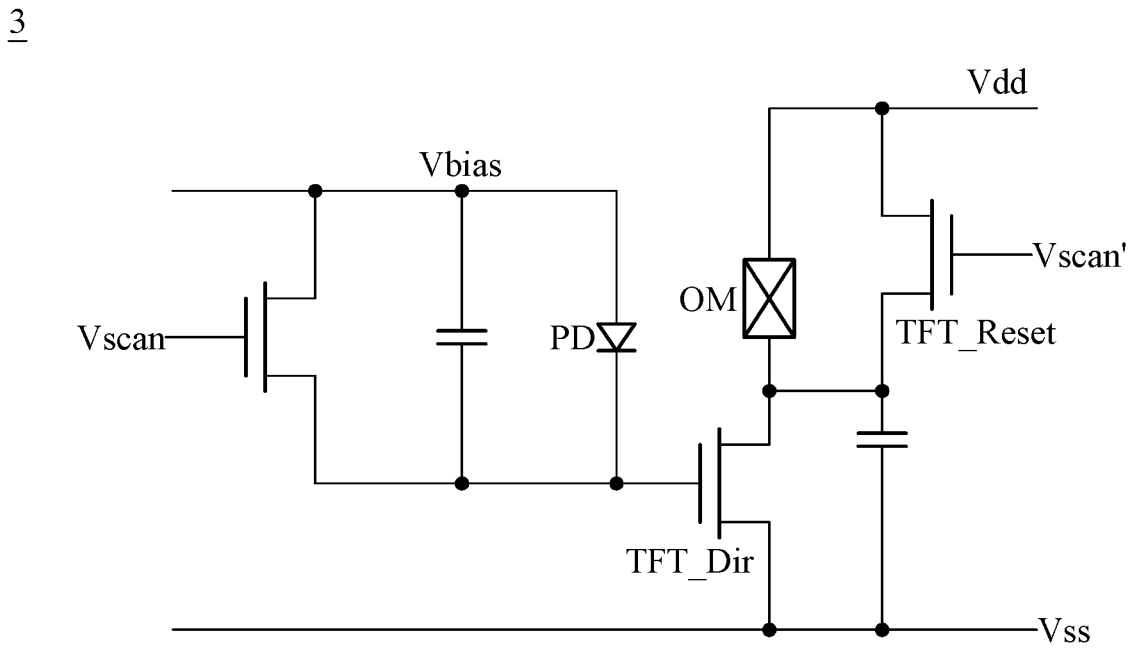
FIG. 6A illustrates circuit diagram of a sensing element/light adjustment element and a dimming element of a third embodiment of the present disclosure.

Please refer to FIG. 6A. FIG. 6A illustrates circuit diagram of a sensing element/light adjustment element and a dimming element of a third embodiment of the present disclosure.

The sensing element and the dimming element of the display device 3 may be arranged as an array and disposed on a substrate. The light-emitting element (such as the light-emitting diode LED) of the display device 3 shown in FIG. 6A may be disposed on another substrate. An extending direction of the substrate may be parallel to an extending direction of the another substrate. In this embodiment, the display elements may be implemented by the light-shielding element OM, and the sensing element/the light adjustment element may be implemented by photo element (for example, the photo diode PD). The circuit structure of the display device 3 shown by FIG. 6A is similar to that of FIG. 5A, the detail of the circuit structure in FIG. 6A is omitted. The key of FIG. 6A is that, the control end of the driving transistor TFT_Dri is connected to the photo diode PD, the first end of the driving transistor TFT_Dri is configured to receive the low-level voltage Vss, and a second end of the driving transistor TFT_Dri is connected to the light-shielding element OM. Therefore, the photo diode PD may be used as the light adjustment element for adjusting the control signal inputted in to the light-shielding element OM.

Figure 6B:
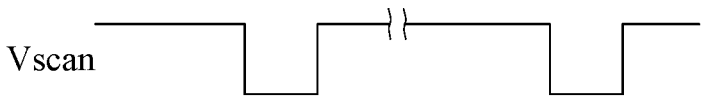
FIG. 6B illustrates waveforms of the voltages in FIG. 6A.

Please refer to FIGS. 6A and 6B together, wherein FIG. 6B illustrates waveforms of the voltages in FIG. 6A. An upper limit of the operating voltage range of the light-emitting diode LED is the high-level voltage Vdd, the lower limit is the low-level voltage Vss, with the bias voltage Vbias being equal to or higher than the high-level voltage Vdd. When the scan voltage Vscan is inputted into the switching transistor TFT_Swi, the initialization begins. That is, the high-level voltage Vdd is written into the light-shielding element OM to make sure the light-shielding element OM is in a transparent state (not shielding light). The bias voltage Vbias is written into the photo diode PD to make sure the voltages at the two ends of the photo diode PD are identical and the switching transistor TFT_Swi is turned off. After the scan voltage Vscan is not inputted into the switching transistor TFT_Swi, the photo diode PD senses the ambient light to generate photovoltaic and to turn on the control transistor for cross voltage of the light-shielding element OM to increase and produce shielding effect. Lastly, the next scan signal initializes the light-shielding element OM and the photo diode PD. Accordingly, the sensing element group SEN may directly control the dimming element M.

In this embodiment, the voltage of the dimming element M is controlled by the impedance of the switch, and said switch of the dimming element M is controlled by the sensing element SEN. The sensing element SEN controls initialization by the same or different switch voltage according to the voltage of photo sensing and the voltage of the dimming element M. Any circuit that conforms to this concept should be considered within the scope of the present invention.

Figure 7A:
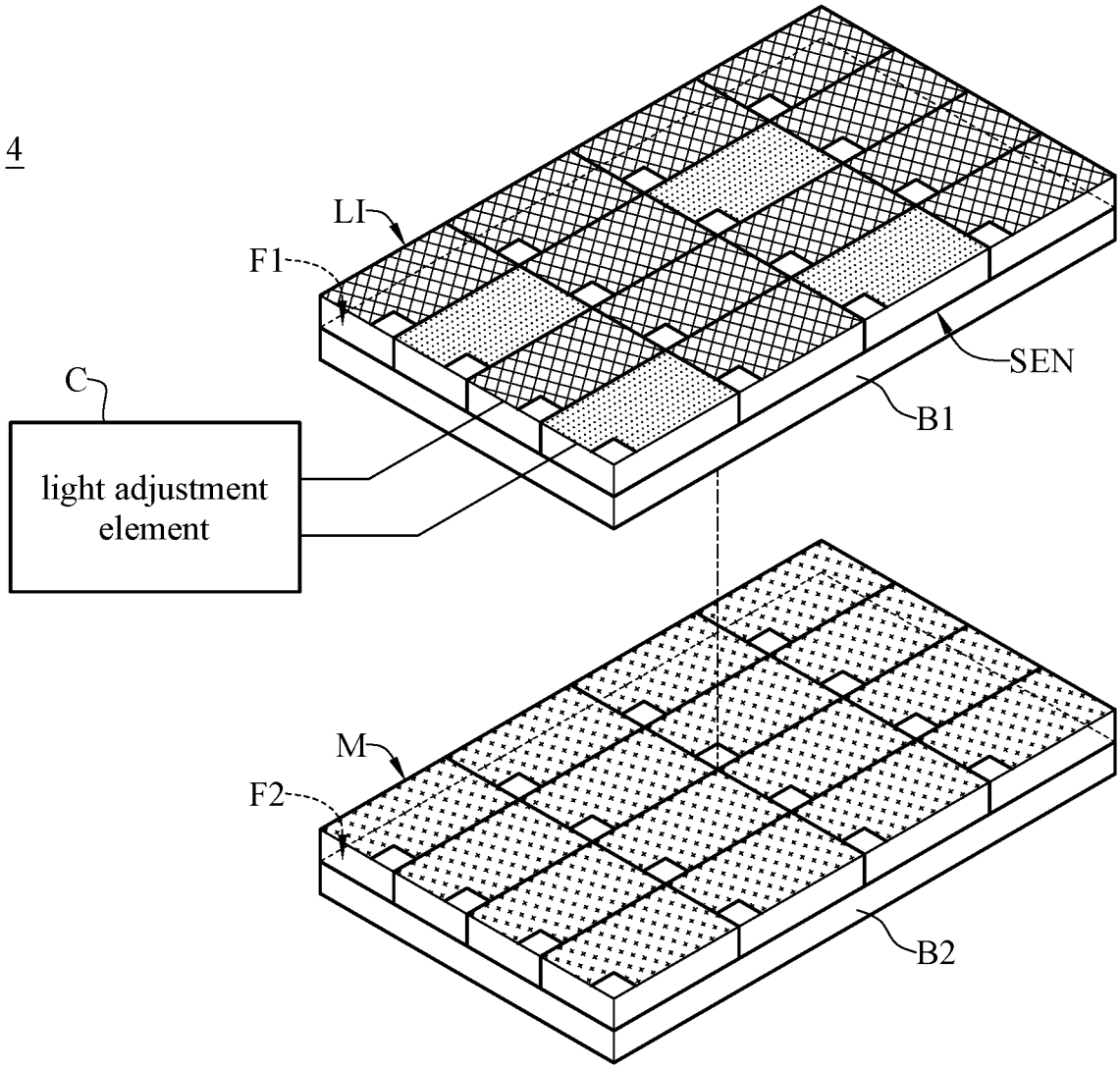
FIGS. 7A and 7B are schematic diagrams illustrating a display device with sensing element according to a fourth embodiment of the present disclosure.
Figure 7B:
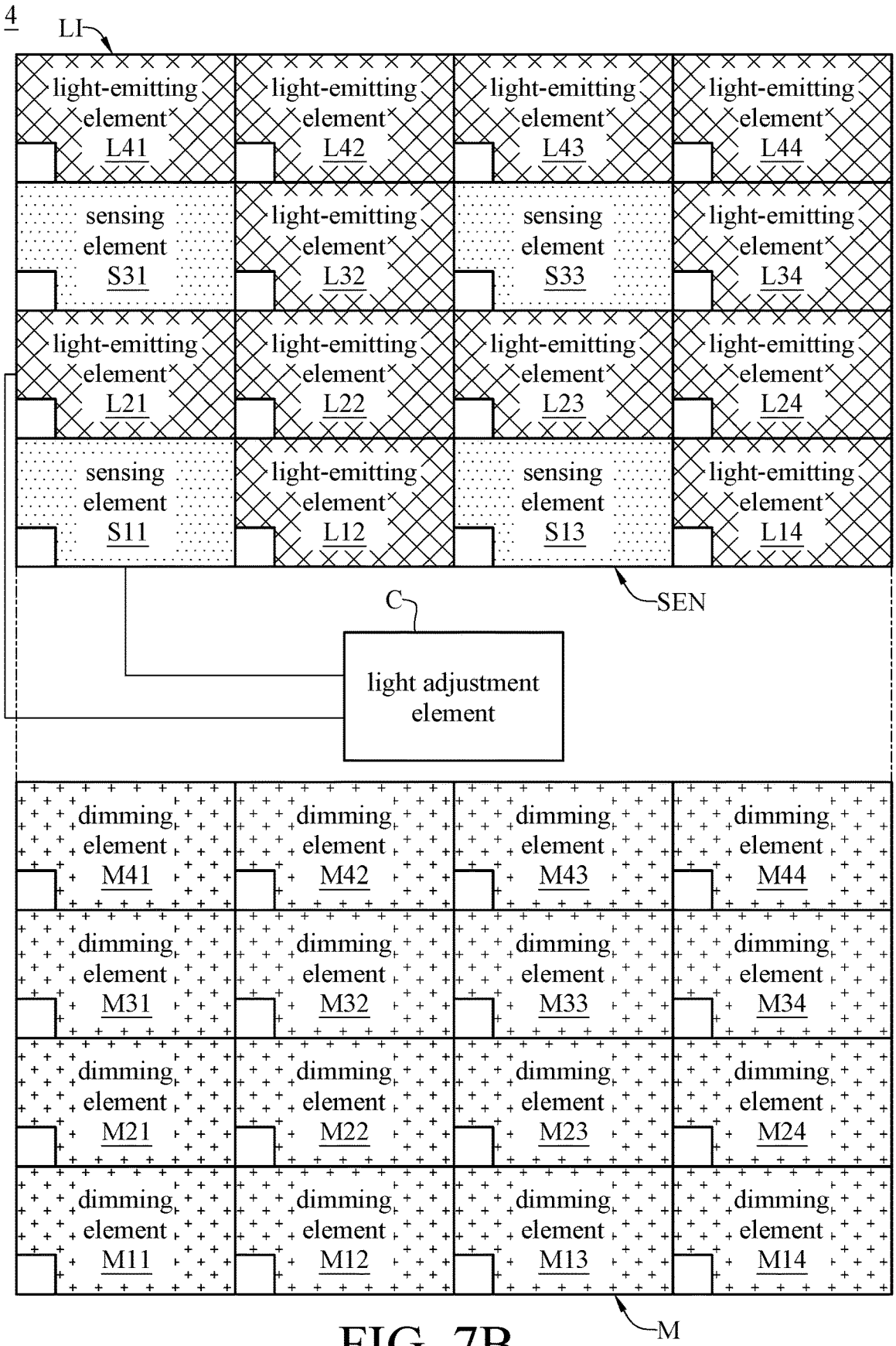

Please refer to FIGS. 7 A and 7B. FIGS. 7A and 7B are schematic diagrams illustrating a display device with sensing element according to a fourth embodiment of the present disclosure. In this embodiment, the display element group DIS of the display device 4 may include the light-emitting element group LI and the dimming element group M.

The light-emitting element group LI and the sensing element group SEN may be arranged as an array and disposed on the substrate B1, the dimming element group M may be disposed as another array and disposed on another substrate B2. An extending direction of the substrate B1 is parallel to an extending direction of the substrate B2. As shown by FIGS. 7A and 7B, the numbers of the light-emitting elements, the dimming elements and the sensing elements are more than 1. The number of the dimming elements may be, for example, the sum of the numbers of the light-emitting elements and the sensing elements. One sensing element may be adjacent to a plurality of light-emitting elements or surrounded by a plurality of light-emitting elements.

Each dimming element may, for example, overlap one light-emitting element or one sensing element. The light adjustment element C is connected to the light-emitting element group LI, the dimming element group M and the sensing element group SEN. Accordingly, the light adjustment element C may adjust the control signals inputted into the corresponding light-emitting elements and/or the dimming elements according to the sensing result of the sensing element group SEN. The details of the light adjustment element C adjusting the control signals according to the sensing result of the sensing element group SEN are described above, and are omitted herein.

In addition, in an embodiment, the light adjustment element C may be connected to the dimming element M and the sensing element group SEN, and the light-emitting element LI is electrically connected to the sensing element group SEN. That is, the control signal inputted into the light-emitting element LI may be adjusted by the sensing element group SEN (for example, the photo diode) and the control signal inputted into the dimming element M may be adjusted by the light adjustment element C.

Figure 8A:
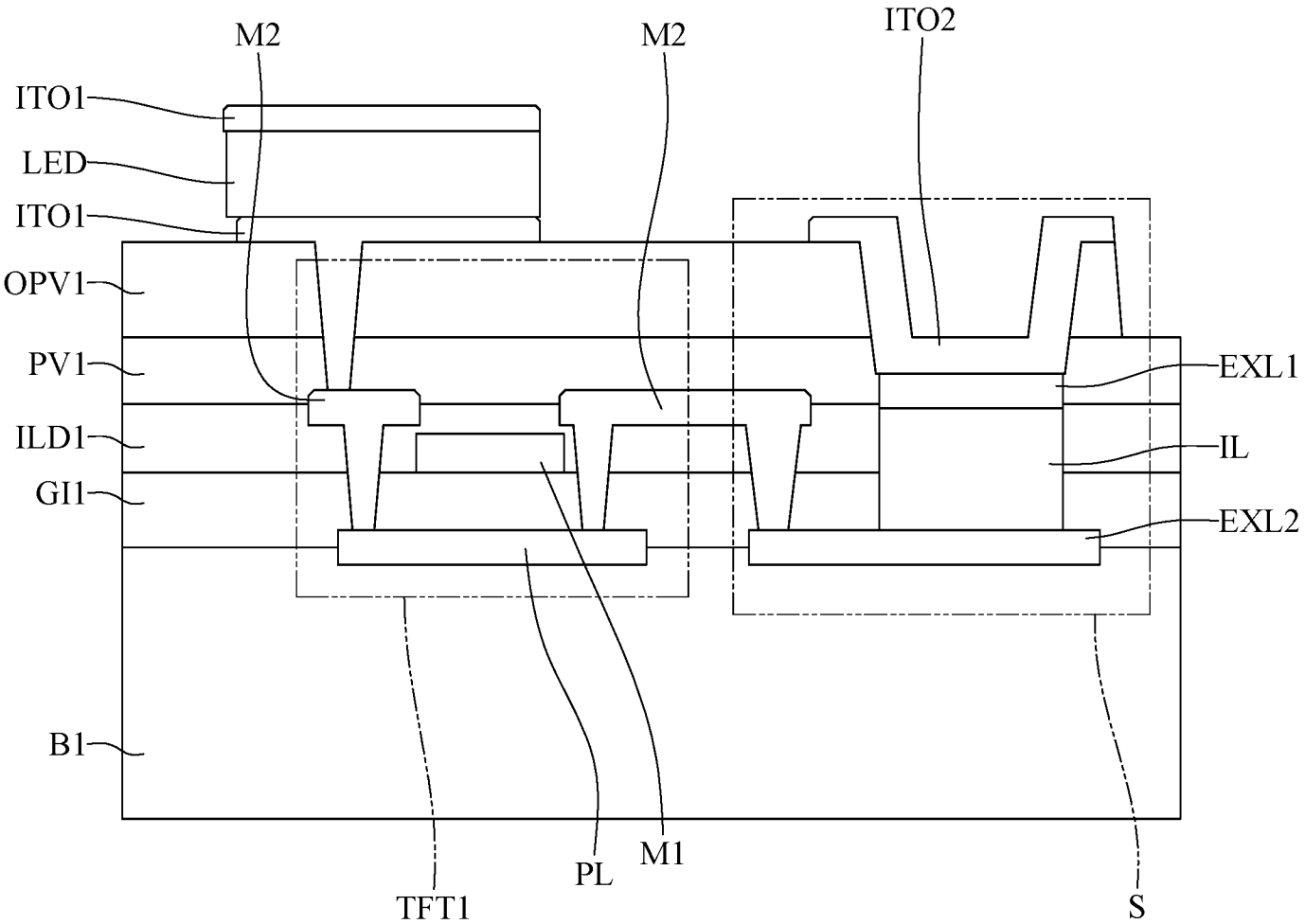
FIGS. 8A and 8B are structural diagrams illustrating the display device with sensing element of the fourth embodiment of the present disclosure.
Figure 8B:
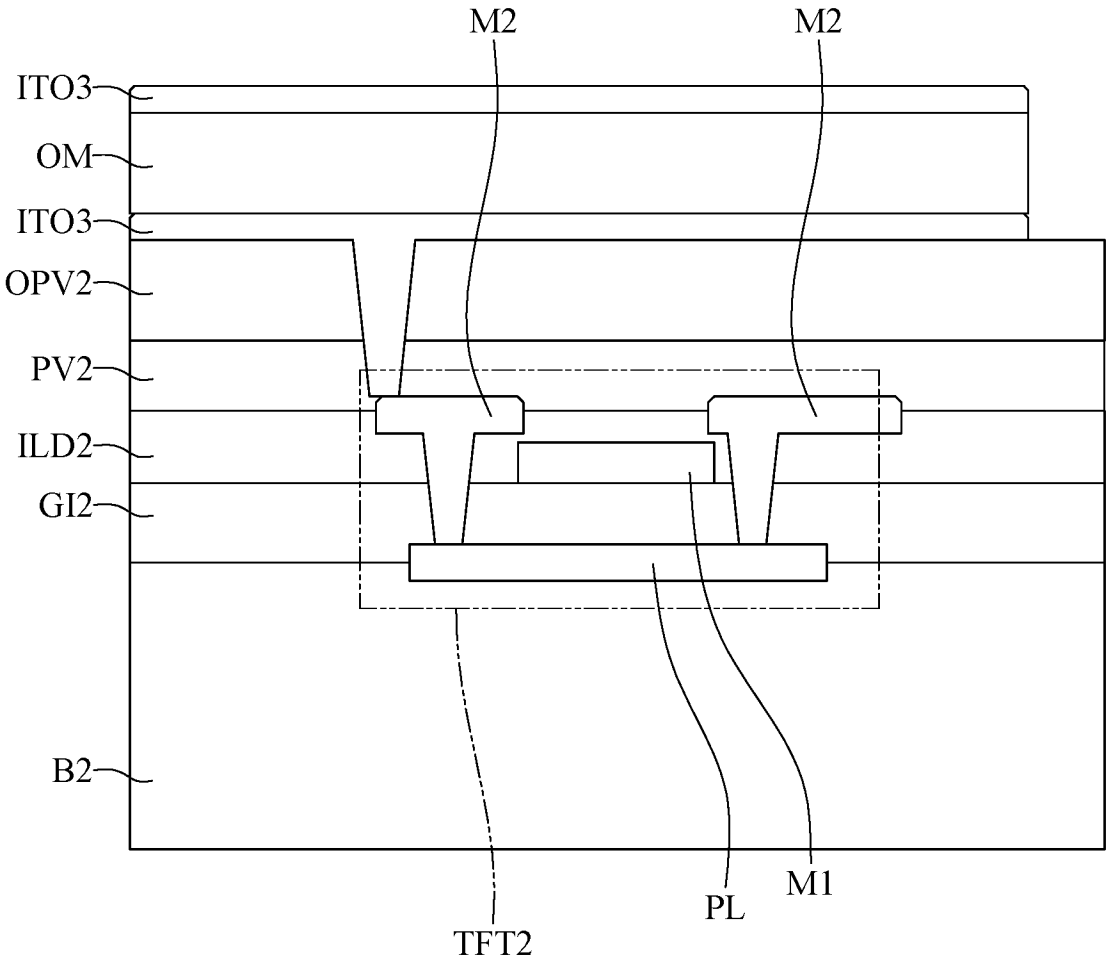

Please refer to FIGS. 8A and 8B. FIGS. 8A and 8B are structural diagrams illustrating the display device with sensing element of the fourth embodiment of the present disclosure. The structure shown by FIGS. 8A and 8B are similar to that of FIG. 2, the following focuses on the difference between the structure shown by FIGS. 8A and 8B and that of FIG. 2.

Please first refer to FIG. 8A, wherein FIG. 8A shows a structure of the light-emitting element LI and the sensing element S are integrated on the same substrate B1. The structure shown by FIG. 8A may include the substrate B1, the first insulating layer GI1, the second insulating layer ILD1, the third insulating layer PV1 and the first planarization insulating layer OPV1. In the embodiment of FIG. 8A, the first transistor TFT1 may penetrate from the third insulating layer PV1 to the first insulating layer GI1. The first transparent electrode ITO1 of the light-emitting diode LED penetrates from the first planarization insulating layer OPV1 to the third insulating layer PV1 and is electrically connected to the second metal electrode M2. The second extrinsic semiconductor layer EXL2 of the sensing element S is electrically connected to the second metal electrode M2. In other words, the light-emitting diode LED and the sensing element S1 are commonly connected to the first transistor TFT1.

Please refer to FIG. 8B, wherein FIG. 8B shows the light-shielding element OM is disposed above another substrate B2. The structure shown by FIG. 8B may include the substrate B2, the first insulating layer GI2, the second insulating layer ILD2, the third insulating layer PV2 and the first planarization insulating layer OPV2. The light-shielding element OM may be disposed on the first planarization insulating layer OPV2, wherein the third transparent electrode ITO3 of the light-shielding element OM may extend from the first planarization insulating layer OPV2 to the third insulating layer PV2 to be electrically connected to the second transistor TFT2. That is, in the embodiment of FIGS. 8A and 8B, the light-emitting element LI and the sensing element S are disposed on the same substrate B1, and the light-shielding element OM is disposed on another substrate B2. The first transistor TFT1 may be the same as the second transistor TFT2 and may be interchanged with each other. Also, when the two substrates B1 and B2 are stacked as shown by FIG. 7A, a projection of the light-shielding element OM on the substrate B1 contains a projection of the light-emitting diode LED on the substrate B1.

Figure 9:
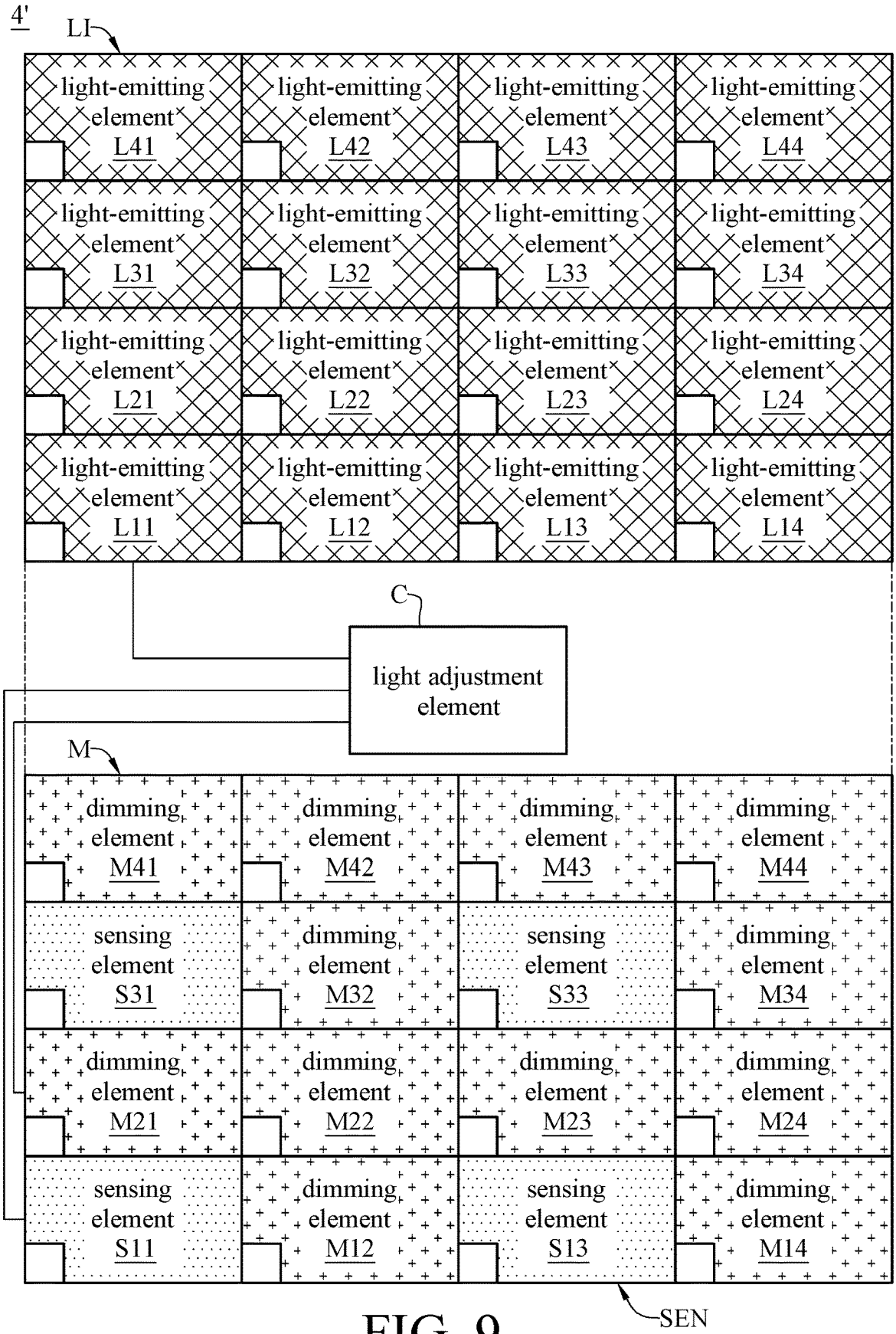
FIG. 9 is a variation of the display device with sensing element of the fourth embodiment of the present disclosure.

Please refer to FIG. 9. FIG. 9 is a variation of the display device with sensing element of the fourth embodiment of the present disclosure. In this embodiment, the display elements of the display device 4' include the light-emitting element group LI and the dimming element group M.

The dimming element group M and the sensing element group SEN may be arranged as an array and disposed on a substrate, and the light-emitting element group LI may be disposed as another array and disposed on another substrate. As shown by FIG. 9, the numbers of the light-emitting elements, the dimming elements and the sensing elements are more than 1. The number of the light-emitting elements may be the sum of the dimming elements and the sensing elements, and one sensing element may be adjacent to a plurality of dimming elements or surrounded by a plurality of dimming elements.

Each light-emitting element may correspondingly overlap one dimming element or one sensing element. The light adjustment element C is connected to the light-emitting element group LI, the dimming element group M and the sensing element group SEN. Accordingly, the light adjustment element C may adjust the control signals inputted into the corresponding light-emitting element and/or the dimming element according to the sensing result of the sensing element group SEN. The details of the light adjustment element C adjusting the control signals according to the sensing result of the sensing element group SEN are described above, and are omitted herein.

Further, in an embodiment, the light adjustment element C may be further connected to the light-emitting element group LI and the sensing element group SEN, and the dimming element group M is electrically connected to the sensing element group SEN. That is, the control signals inputted into the light-emitting element group LI may be adjusted by the light adjustment element C, and the control signals inputted into the dimming element group M may be adjusted by the sensing element group SEN (for example, the photo diode).

Figure 10A:
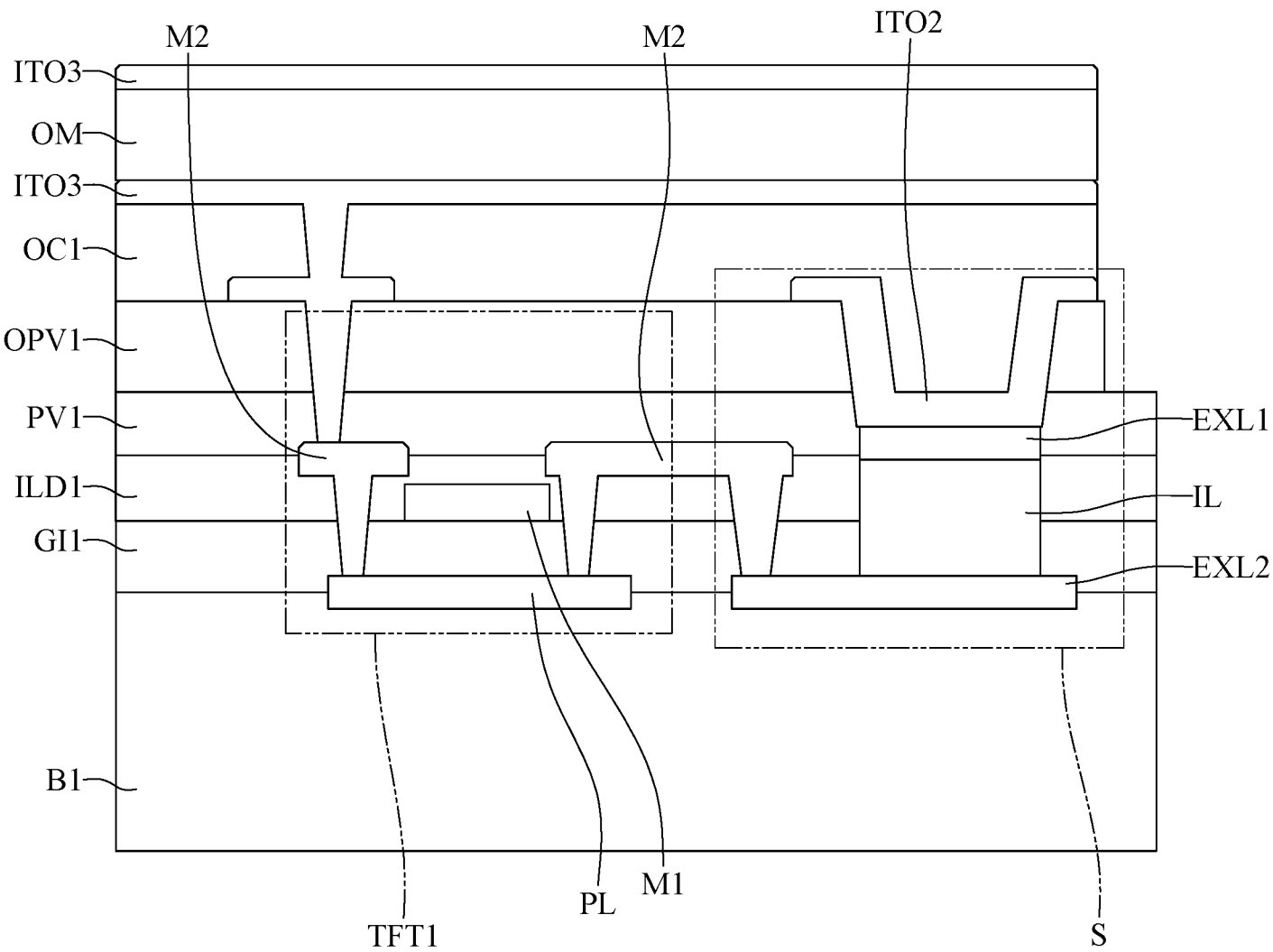
FIGS. 10A and 10B are structural diagrams illustrating the variation of the display device with sensing element of the fourth embodiment of the present disclosure.
Figure 10B:
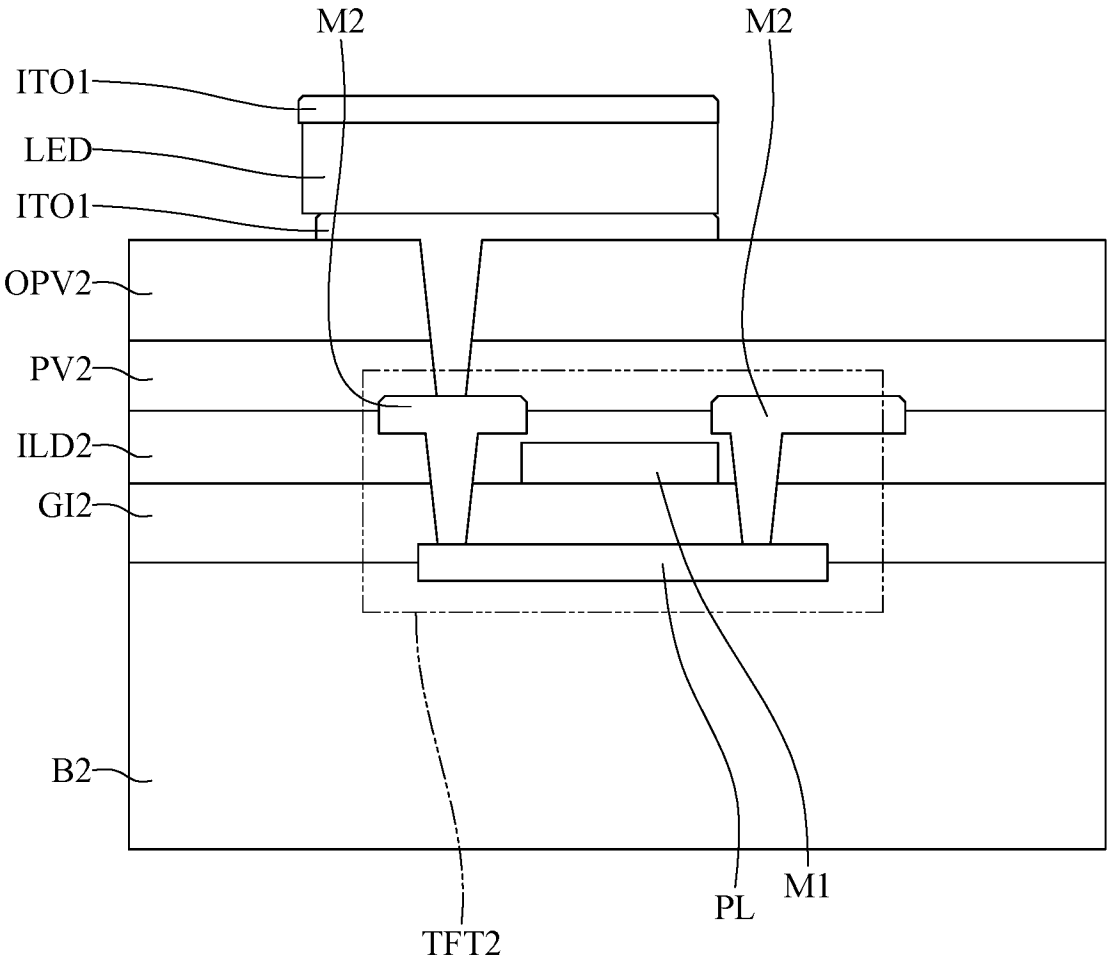

Please refer to FIGS. 10A and 10B. FIGS. 10A and 10B are structural diagrams illustrating the variation of the display device with sensing element of the fourth embodiment of the present disclosure. The structure shown by FIGS. 10A and 10B are similar to that of FIG. 2, the following focuses on the difference between the structure shown by FIGS. 10A and 10B and that of FIG. 2. Similar to FIGS. 8A and 8B, the display device of FIGS. 10A and 10B may also include two substrates B1 and B2.

Please refer to FIG. 10A, wherein FIG. 10A shows the light-shielding element OM and the sensing element S are integrated on the same substrate B1. The structure of FIG. 10A includes the second planarization insulating layer OC1 disposed on the first planarization insulating layer OPV1. In this embodiment, the light-shielding element OM and the sensing element S are disposed above the substrate B1, wherein the embodiment of FIG. 10A does not include the light-emitting element. The third transparent electrode ITO3 of the light-shielding element OM is electrically connected to a second metal electrode M2 of the first transistor TFT1, and the second extrinsic semiconductor layer EXL2 of the sensing element S is electrically connected to another second metal electrode of the first transistor TFT1. In other words, the light-shielding element OM and the sensing element S1 may be commonly connected to the first transistor TFT1.

Please refer to FIG. 10B, wherein FIG. 10B shows the light-emitting element (for example, the light-emitting diode LED) is disposed above another substrate B2. The light-emitting diode LED may be disposed on the first planarization insulating layer OPV2, wherein the first transparent electrode ITO1 of the light-emitting diode LED is electrically connected to the second metal electrode M2 of the second transistor TFT2. That is, in the embodiment of FIGS. 10A and 10B, the light-shielding element OM and the sensing element S are disposed on the same substrate B1, and the light-emitting element is disposed on another substrate B2. The first transistor TFT1 may be the same as the second transistor TFT2, and may be interchanged with each other. Also, when the two substrates are stacked with each other, a projection of the light-shielding element OM on the substrate B1 contains a projection of the light-emitting diode LED on the substrate B1.

Figure 13A:
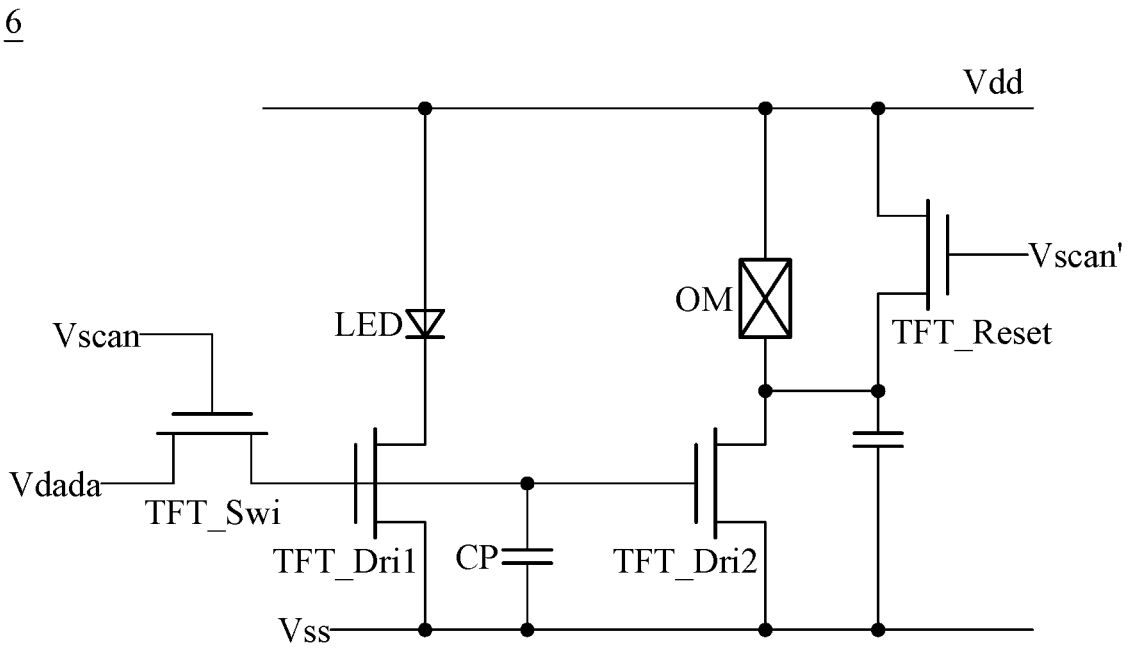
FIG. 13A illustrates circuit diagram of a light-emitting element and a dimming element of the present disclosure.

In this embodiment, since the operating voltages of the light-emitting element LI and the dimming element M (for example, the light-emitting diode LED and electrochromic element EC) are different, data voltage is written into a first driving transistor (for example, the first driving transistor TFT_Dri1 shown in FIG. 13A) and a second driving transistor (for example, the second the driving transistor TFT_Dri2 shown in FIG. 13A) through active switch, wherein the first driving transistor and the second driving transistor control a partial voltage of the light-emitting element LI and a partial voltage of the dimming element M. Through designing the impedance of these two driving transistors, the two driving transistors may be controlled by the same data voltage at the same time. Any circuit that conforms to this concept should be considered within the scope of the present invention.

Figure 11:
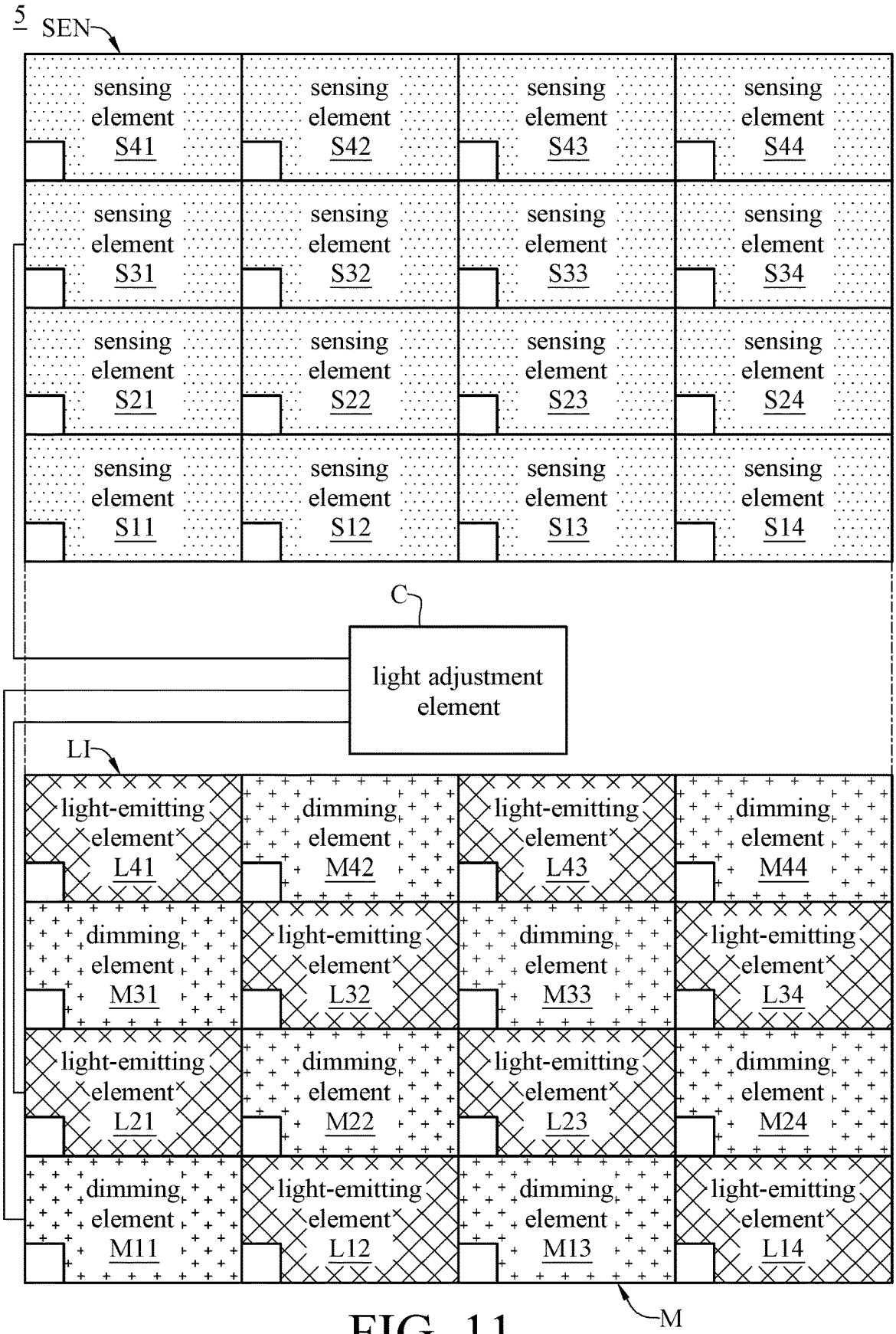
FIG. 11 is a schematic diagram illustrating a display device with sensing element according to a fifth embodiment of the present disclosure.

Please refer to FIG. 11. FIG. 11 is a schematic diagram illustrating a display device with sensing element according to a fifth embodiment of the present disclosure. In this embodiment, the display elements of the display device 5 include the light-emitting element group LI and the dimming element group M.

The dimming element group M and the light-emitting element group LI may be arranged as an array and disposed on a substrate, wherein the dimming elements and the light-emitting elements may be alternatively disposed with one another. The sensing element group SEN may be disposed as another array and disposed on another substrate. As shown by FIG. 11, the numbers of the light-emitting elements, the dimming elements and the sensing elements are more than 1, and the number of the sensing elements may be the sum of the numbers of the dimming elements and the light-emitting elements.

In addition, each sensing element may correspondingly overlap one dimming element or one light-emitting element. The light adjustment element C is connected to the light-emitting element group LI, the dimming element group M and the sensing element group SEN. Accordingly, the light adjustment element C may adjust the control signals inputted into the corresponding light-emitting elements and/or the dimming elements according to the sensing result of the sensing element group SEN. For example, when the light adjustment element C determines the sensed light brightness of the sensing element S23 changes and the image contrast of the display device 5 may need to be adjusted, the light adjustment element C may adjust the control signals inputted into the light-emitting element L23 and/or the light-emitting element L34, as well as adjust the control signals inputted into the dimming element M24 and/or M24.

Figure 12A:
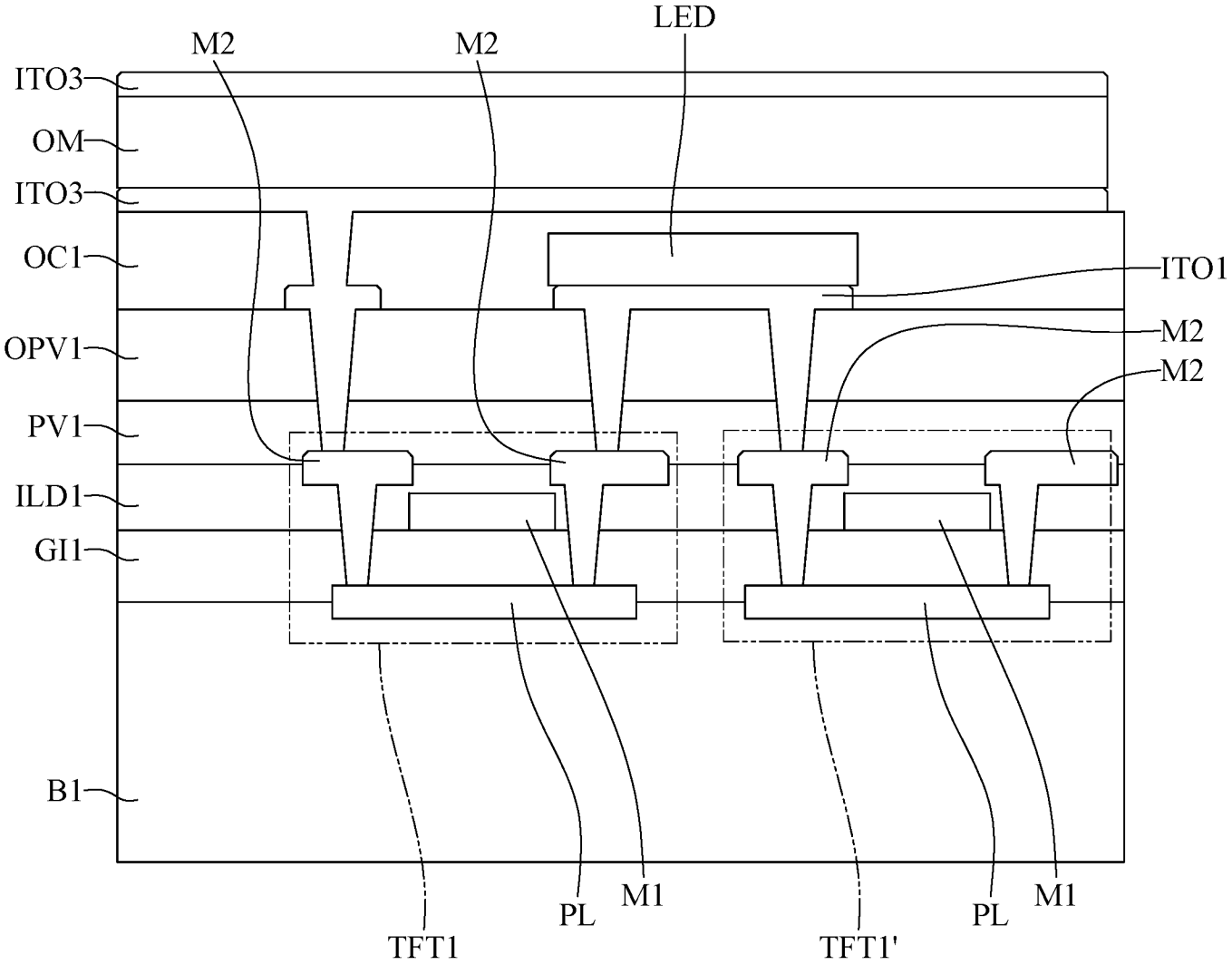
FIGS. 12A and 12B are structural diagrams illustrating the display device with sensing element of the fifth embodiment of the present disclosure.
Figure 12B:
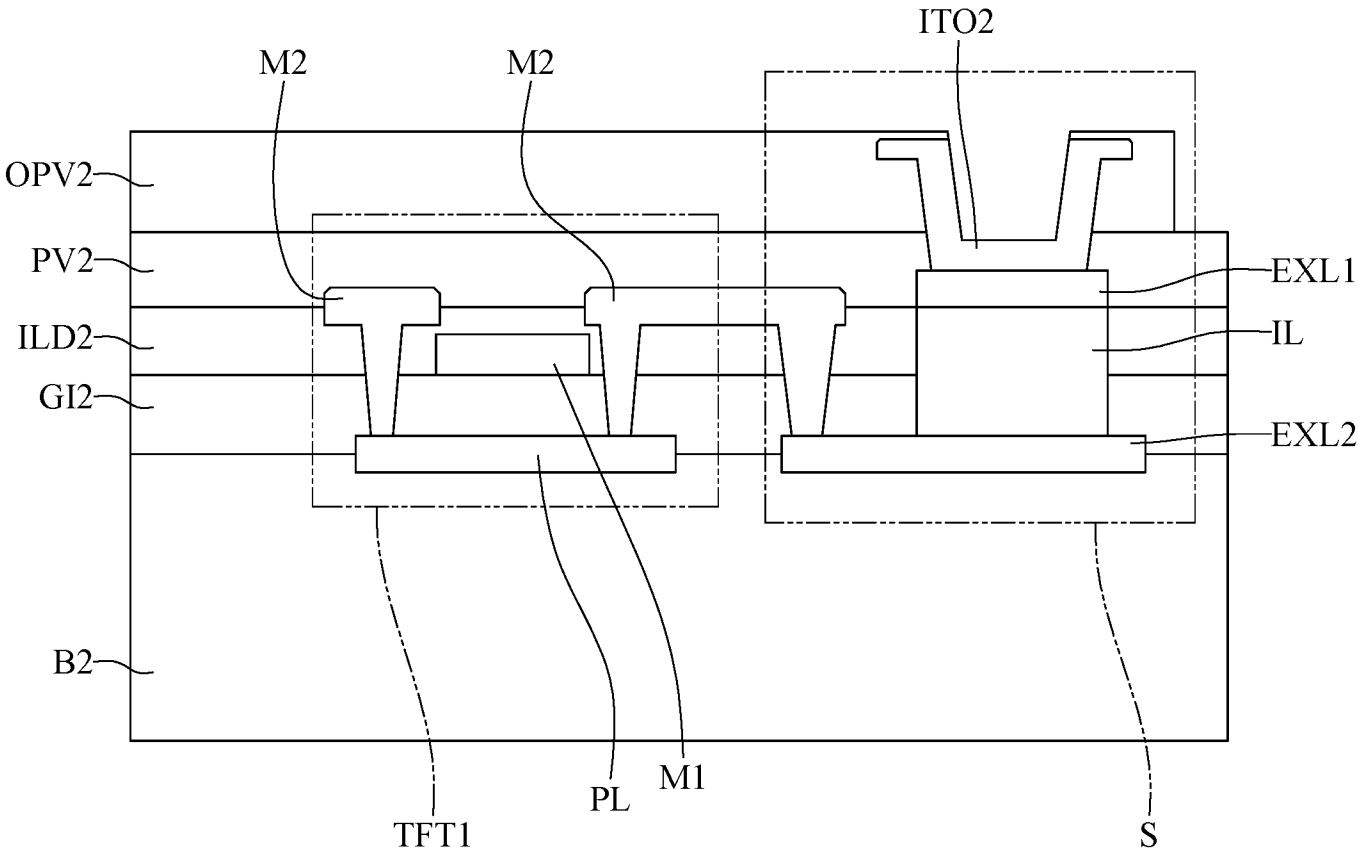

FIGS. 12A and 12B are structural diagrams illustrating the display device with sensing element of the fifth embodiment of the present disclosure. The structure shown by FIGS. 12A and 12B are similar to that of FIG. 2, the following focuses on the difference between the structure shown by FIGS. 12A and 12B and that of FIG. 2. Similar to FIGS. 8A and 8B, the display device of FIGS. 12A and 12B may also include two substrates B1 and B2.

Please refer to FIG. 12A, wherein FIG. 12A shows the light-shielding element OM and the light-emitting element (for example, the light-emitting diode LED) are integrated on the same substrate B1. The structure of FIG. 12A includes the second planarization insulating layer OC1 disposed on the first planarization insulating layer OPV1. In this embodiment, the light-shielding element OM and the light-emitting diode LED are disposed above the substrate B1, the embodiment of FIG. 12A does not include the sensing element S. The first transparent electrode ITO1 of the light-emitting diode LED is connected to the two first transistors TFT1 and TFT1'. The first transparent electrode ITO1 of the light-emitting diode LED and the third transparent electrode ITO3 of the light-shielding element OM may be commonly connected to the first transistor TFT1.

Please refer to FIG. 12B, wherein FIG. 12B shows the sensing element S is disposed on another substrate B2. Depending on the design requirement, the second planarization insulating layer may not be disposed on the sensing element S. In the embodiment of FIGS. 12A and 12B, the light-shielding element OM and the light-emitting element LI are disposed on the same substrate B1, and the sensing element S is disposed on another substrate B2. The first transistors TFT1, TFT1' may be the same as the second transistor TFT2, and may be interchanged with each other. Also, when the two substrates are stacked with each other, a projection of the light-shielding element OM on the substrate B1 contains a projection of the light-emitting diode LED on the substrate B1.

Please refer to FIG. 13A. FIG. 13A illustrates circuit diagram of a light-emitting element and a dimming element of the present disclosure. In this embodiment, the light-emitting element group LI and the dimming element group M of the display device 6 may be disposed on a substrate, and the sensing element group SEN may be disposed on another substrate. In this embodiment, the light-emitting element may be implemented by the light-emitting diode LED, and the dimming element may be implemented by the light-shielding element OM.

The control end of the switching transistor TFT_Swi is configured to receive the scan voltage Vscan, the first end of the switching transistor TFT_Swi is configured to receive the data voltage Vdata, and the second end of the switching transistor TFT_Swi is connected to the control end of the first driving transistor TFT_Dri1. The first end of first driving transistor TFT_Dri1 is configured to receive the low-level voltage Vss, and the second end of the first driving transistor TFT_Dri1 is connected to the cathode of the light-emitting diode LED. The anode of the light-emitting diode LED is configured to receive the high-level voltage Vdd.

The control end of the second driving transistor TFT_Dri2 is connected to the control end of the first driving transistor TFT_Dri1, and the two control ends may be electrically connected to a capacitor CP. The capacitor CP is, for example, configured to receive a noise between the first driving transistor TFT_Dri1 and the second driving transistor TFT_Dri2. The first end of the second driving transistor TFT_Dri2 and the first end of the first driving transistor TFT_Dri1 share the same voltage potential, the second end of the second driving transistor TFT_Dri2 is connected to the light-shielding element OM and the reset transistor TFT_Reset. The control end of the reset transistor TFT_Reset is configured to receive the scan voltage Vscan' of the previous stage. Specifically, the data voltage Vdata may be the control signal, and the light-emitting diode LED and the light-shielding element OM may receive the data voltage Vdata to adjust the image contrast of the display device.

Figure 13B:
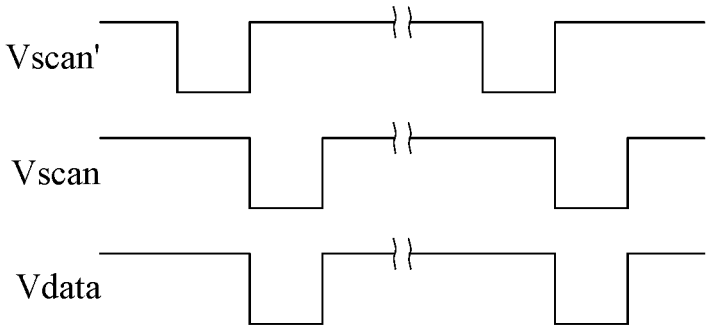
FIG. 13B illustrates waveforms of the voltages in FIG. 13A.

Please refer to FIGS. 13A and 13B together, wherein FIG. 13B illustrates waveforms of the voltages in FIG. 13A. An upper limit of the operating voltage range of the light-emitting diode LED is the high-level voltage Vdd, the lower limit is the low-level voltage Vss, with the data voltage Vdata being between the high-level voltage Vdd and the low-level voltage Vss. When the scan voltage Vscan is inputted into the switching transistor TFT_Swi, the light-emitting diode LED and the light-shielding element OM are activated by the data voltage Vdata. Accordingly, the light-shielding element OM may change the transmittance of the display device. In addition, the reset transistor TFT_Reset performs reset process before data writing to initialize the light-shielding element OM according to the scan voltage Vscan' of the previous stage.

Figure 14:
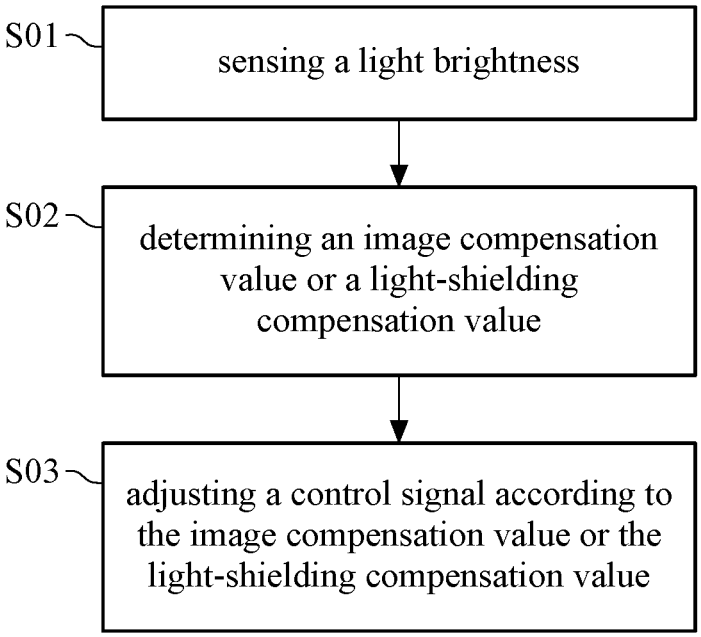
FIG. 14 illustrates operation process of a display device with sensing element according to an embodiment of the present disclosure.

The display device of the present disclosure may adjust the image contrast, wherein the operation of the display device of the present disclosure is shown by FIG. 14. FIG. 14 illustrates operation process of a display device with sensing element according to an embodiment of the present disclosure. In step S01, the sensing element of the sensing element group SEN senses the light brightness of the light projected to the display device 1. The sensing element converts the sensed photo signal into the light brightness in electrical signal form, and outputs the light brightness to the light adjustment element C.

Then, in step S02, the light adjustment element C determines the image compensation value or the light-shielding compensation value according to the light brightness. When the light brightness indicates the image presented by the display device is too bright, the light adjustment element C determines the image compensation value; and when the light brightness indicates the image presented by the display device is too dark, the light adjustment element C determines the light-shielding compensation value. In addition, the light adjustment element C may further use the brightness of each of the three primary colors of RGB calculated from the target white balance color coordinates as the image compensation value or the light-shielding compensation value. Or, the light adjustment element C may use the brightness of each of the three primary colors of RGB calculated from the target white balance color coordinates as the compensation value after obtaining the image compensation value or the light-shielding compensation value. The light adjustment element C may store a plurality of brightness values, a plurality of image compensation values, a plurality of light-shielding compensation values and a plurality of compensation values of RGB color balance in advance. The light adjustment element C may obtain the image compensation value, the light-shielding compensation value or the compensation value of RGB color balance by look-up table to determine the compensation value corresponding to the current light brightness.

In step S03, the light adjustment element C adjusts a plurality of control signals inputted into the display elements of the display element group DIS according to the image compensation value or the light-shielding compensation value, in order to determine the image contrast of the display element group DIS. In this step, the light adjustment element C compensates the signal inputted into the display elements according to the compensation value to generate and output the adjusted control signals. The adjusted control signals are the compensation voltage or compensation current after being compensated. Accordingly, the image contrast of the display device may be adjusted in real time according to the ambient light.

In view of the above description, the display device with sensing element according to one or more embodiments of the present application may collect the sensing signal of a partial area to adjust the contrast of the area, thereby improving the visibility of the display device. Accordingly, image visibility may be improved, and driving safety may also be improved as well as avoid the viewer from feeling discomfort in the eyes. In addition, in the display device with sensing element according to one or more embodiments of the present application, by integrating the light adjustment element into the display panel, the display device may have light adjustment function and may maintain the lightness and thinness of the display device. Further, according to one or more embodiments of the present application, the element inside the display device may adjust the image contrast without the need for additional adjustment through external system side.

Although the aforementioned embodiments of this invention have been described above, this invention is not limited thereto. The amendment and the retouch, which do not depart from the spirit and scope of this invention, should fall within the scope of protection of this invention. For the scope of protection defined by this invention, please refer to the attached claims.

SYMBOLIC EXPLANATION

1, 1*a*, 1*b*, 2~4, 4', 5, 6: display device
B, B1, B2: substrate
F: disposing surface
C: light adjustment element
DIS: display element group
D12, D14, D21~D24, D32, D34, D41~D44: display element
SEN: sensing element group
S11~S14, S21~S24, S31~S34, S41~S44: sensing element
LI: light-emitting element group
L11~L14, L21~L24, L31~L34, L41~L44: light-emitting element
M: dimming element group
M11~M14, M21~M24, M31~M34, M41~M44: dimming element
GI, GI1, GI2: first insulating layer
ILD, ILD1, ILD2: second insulating layer
PV, PV1, PV2: third insulating layer
OPV, OPV1, OPV2: first planarization insulating layer
OC, OC1: second planarization insulating layer
TFT1, TFT1': first transistor
TFT2: second transistor
PL: polysilicon layer
M1: first metal electrode
M2: second metal electrode
CP, Chold: capacitor
LED: light-emitting diode
OM: light-shielding element
PD: photo diode
ITO1: first transparent electrode
ITO2: second transparent electrode
ITO3: third transparent electrode
EXL1: first extrinsic semiconductor layer
EXL2: second extrinsic semiconductor layer
IL: intrinsic semiconductor layer
TFT_Swi: switching transistor
TFT_Ctrl: control transistor
TFT_Dri: driving transistor
TFT_Dri1: first driving transistor
TFT_Dri2: second driving transistor
TFT_Reset: reset transistor
Vscan, Vscan': scan voltage
Vdata: data voltage
Vss: low-level voltage
Vdd: high-level voltage
Vbias: bias voltage

What is claimed is:

1. A display device with sensing element, comprising:

a substrate having a disposing surface;

a plurality of display elements, disposed above the disposing surface to present an image;

at least one sensing element disposed above the disposing surface to sense light brightness of light projected toward either side of the substrate; and at least one light adjustment element in signal-transmittable connection with the display elements and the at least one sensing element, with the at least one light adjustment element calculating an image compensation value according to the light brightness to adjust a plurality of control signals inputted into the display elements for matching a value calculated from equation (1) to a default ratio, to determine a contrast of the image, $$\frac{L_{ENV} + L_{DIS1} + L_{DISR}}{L_{ENV} + L_{DIS2} + L_{DISR}} \quad \text{equation (1)}$$

wherein $L_{ENV}$ is the light brightness sensed by the at least one sensing element; $L_{DIS1}$ is a first brightness corresponding to the control signals; $L_{DIS2}$ is a second brightness corresponding to the control signals; $L_{DISR}$ is a brightness corresponding to the light of the light brightness reflected from the display device, wherein the first brightness is higher than the second brightness.

2. The display device with sensing element according to claim 1, wherein the display elements comprises a light-emitting element, and the at least one light adjustment element adjusts the control signals inputted into the light-emitting element according to the image compensation value.

3. The display device with sensing element according to claim 2, wherein the at least one light adjustment element stores a plurality of brightness values and a plurality of compensation values corresponding to the brightness values, with the at least one light adjustment element determining the light brightness falling in an interval defined by two of the brightness values, and using one of the compensation values corresponding to the interval as the image compensation value.

4. The display device with sensing element according to claim 2, wherein the at least one sensing element comprises a photo diode, and the light-emitting element comprises a light emitting diode.

5. The display device with sensing element according to claim 4, wherein a cathode of the light emitting diode is configured to receive a low-level voltage, an anode of the light emitting diode is connected to a control transistor, a cathode of the photo diode is connected to a control end of the control transistor, and an anode of photo diode is configured to receive an offset voltage.

6. The display device with sensing element according to claim 1, wherein the display elements comprise a dimming element, and the at least one light adjustment element calculates a light-shielding compensation value according to the light brightness to adjust the control signals inputted into the dimming element according to the light-shielding compensation value.

7. The display device with sensing element according to claim 6, wherein the at least one light adjustment element stores a plurality of brightness values and a plurality of compensation values corresponding to the brightness values, with the at least one light adjustment element determining the light brightness falling in an interval defined by two of the brightness values, and using one of the compensation values corresponding to the interval as the light-shielding compensation value.

8. The display device with sensing element according to claim 6, wherein the at least one sensing element comprises a photo diode, and the dimming element comprises a light-shielding element.

9. The display device with sensing element according to claim 8, wherein a cathode of the photo diode is connected to a control end of a driving transistor, an anode of the photo diode is configured to receive an offset voltage, a first end of the driving transistor is configured to receive a low-level voltage, a second end of the driving transistor is connected to a first end of the light-shielding element, and a second end of the light-shielding element is configured to receive a high-level voltage.

10. The display device with sensing element according to claim 1, wherein the display elements comprise a light-emitting element and a dimming element, and the at least one light adjustment element further calculates a light-shielding compensation value according to the light brightness to further adjust the control signals inputted into the dimming element and the light-emitting element according to the image compensation value and the light-shielding compensation value.

11. The display device with sensing element according to claim 10, wherein the light-emitting elements and the at least one sensing element are disposed on the disposing surface, the dimming element is disposed on another disposing surface of another substrate, and an extension direction of the substrate is parallel to an extension direction of the another substrate.

12. The display device with sensing element according to claim 10, wherein the at least one sensing element is disposed on the disposing surface, the light-emitting element and the dimming element are disposed on another disposing surface of another substrate, and an extension direction of the substrate is parallel to an extension direction of the another substrate.

13. The display device with sensing element according to claim 10, wherein the light-emitting element comprises a light emitting diode, and the dimming element comprises a light-shielding element.

14. The display device with sensing element according to claim 13, wherein an anode of the light emitting diode and a first end of the light-shielding element receive a high-level voltage, a cathode of the light emitting diode is connected a first end of a first driving transistor, a second end of the light-shielding element is electrically connected to a first end of a second driving transistor, and a second end of the first driving transistor and a second end of the second driving transistor are configured to receive a low-level voltage.

15. The display device with sensing element according to claim 1, wherein the at least one light adjustment element comprises a computing element.

16. The display device with sensing element according to claim 1, wherein the at least one sensing element and the at least one light adjustment element comprise a photo diode.

17. The display device with sensing element according to claim 1, wherein the at least one sensing element and the display elements are disposed on the disposing surface.

* * * * *